US011329367B2

(12) United States Patent
Huang et al.

(10) Patent No.: US 11,329,367 B2
(45) Date of Patent: May 10, 2022

(54) ANTENNA DEVICE AND ELECTRONIC APPARATUS

(71) Applicant: Etheta Communication Technology (Shenzhen) Co., Ltd., Shenzhen (CN)

(72) Inventors: Huan-Chu Huang, Taoyuan (CN); Dasong Gao, Shenzhen (CN); Zhixing Qi, Shenzhen (CN); Hong Lin, Shenzhen (CN); Yanchao Zhou, Shenzhen (CN)

( * ) Notice: Subject to any disclaimer, the term of this patent is extended or adjusted under 35 U.S.C. 154(b) by 0 days.

(21) Appl. No.: 17/553,684

(22) Filed: Dec. 16, 2021

(65) Prior Publication Data

US 2022/0109228 A1 Apr. 7, 2022

(30) Foreign Application Priority Data

Nov. 16, 2021 (CN) ..... 202111355158.7

(51) Int. Cl.
*H01Q 1/24* (2006.01)
*H01Q 1/42* (2006.01)
*H01Q 1/52* (2006.01)

(52) U.S. Cl.
CPC ..... *H01Q 1/243* (2013.01); *H01Q 1/42* (2013.01); *H01Q 1/526* (2013.01)

(58) Field of Classification Search
CPC .... H01Q 1/243; H01Q 21/065; H01Q 1/2283; H01Q 1/38; H01Q 9/0407; H01Q 21/08; H01Q 1/02; H01Q 21/28; H01Q 3/24; H01Q 1/42; H01Q 21/061; H01Q 3/36
USPC ..... 455/575.5
See application file for complete search history.

(56) References Cited

U.S. PATENT DOCUMENTS

| | | | | |
|---|---|---|---|---|
| 2019/0058246 | A1 | 2/2019 | Lee et al. | |
| 2019/0319341 | A1* | 10/2019 | Park | H01Q 21/065 |
| 2019/0385787 | A1 | 12/2019 | Ichikawa | |
| 2020/0203831 | A1 | 6/2020 | Ichikawa | |
| 2021/0007213 | A1* | 1/2021 | Ryu | H01Q 1/243 |

* cited by examiner

*Primary Examiner* — Ajibola A Akinyemi

(57) ABSTRACT

The present disclosure discloses an antenna device and an electronic apparatus having the antenna device. The antenna device includes a first antenna structure and a second antenna structure; the first antenna structure includes a first mm-wave antenna and a first mm-wave RFIC electrically connected with the first mm-wave antenna; and the second antenna structure includes a flexible printed circuit board and a second mm-wave antenna arranged on the flexible printed circuit board. The first antenna structure includes a first non-mm-wave antenna and/or the second antenna structure includes a second non-mm-wave antenna arranged on the flexible printed circuit board.

20 Claims, 27 Drawing Sheets

ANTENNA DEVICE AND ELECTRONIC APPARATUS

TECHNICAL FIELD

The present disclosure relates to the technical field of antennas, in particular to an antenna device and an electronic apparatus having the above-mentioned antenna device.

BACKGROUND ART

With the advent of the 5G era, communication requirements of higher-order multiple-input and multiple-output (MIMO), coverage requirements of more new frequency bands, and even addition of millimeter wave bands have led to a need of an electronic apparatus such as a mobile phone for having more antennas (i.e., including millimeter wave (mm-wave) and non-mm-wave antennas). If the whole space cannot be significantly enlarged, higher antenna design difficulty will be caused, and even the production competitiveness is reduced because of increase in the overall size due to less compact antenna placement or design. A 5G frequency band is divided into a mm-wave band and a non-mm-wave band. A current mainstream antenna for the non-mm-wave band is designed to be a discrete antenna. Mainstream implementation methods include stamped iron sheets, flexible printed circuits (FPC), laser direct structuring (LDS), printed direct structuring (PDS), etc.; and a current mainstream antenna for the mm-wave band is designed to be an integrated antenna-in-package (AiP), that is, an antenna and a chip (especially a radio-frequency integrated circuit (RFIC)) are integrated into an AiP module. As mentioned above, the number of antennas in the 5G era has increased significantly, so a plurality of discrete 5G non-mm-wave antennas and several 5G mm-wave antenna modules are required in a 5G device (if the device can support mm-wave communication).

In addition, as we all know, spaces on internal boards of electronic apparatuses such as a mobile phone are quite tight and compact, and this situation is becoming more and more serious. Therefore, how to accommodate multiple kinds of antennas with qualified performance under a limited system space and acceptable cost and make a board space achieve better utilization rate is a hot topic in the design of antenna devices for mobile phones and other electronic apparatuses.

SUMMARY

In view of this, it is necessary to provide an antenna device and an electronic apparatus to improve the above-mentioned problems.

In order to achieve the above objective, in a first aspect, one embodiment of the present disclosure discloses an antenna device, including:

a first antenna structure including a first millimeter wave (mm-wave) antenna and a first mm-wave radio-frequency integrated circuit (RFIC) electrically connected to the first mm-wave antenna;

a second antenna structure including a flexible printed circuit board and a second mm-wave antenna arranged on the flexible printed circuit board.

In particular, the first antenna structure includes a first non-mm-wave antenna and/or the second antenna structure includes a second non-mm-wave antenna arranged on the flexible printed circuit board.

The antenna device provided in the embodiment of the present disclosure includes the first antenna structure and the second antenna structure, and the mm-wave antenna and the non-mm-wave antenna are integrated, which is conductive to solving the challenge for disposing a number of antennas in the above-mentioned 5G mobile phone; a higher space utilization rate is achieved under a limited space; and the antenna performance, the antenna communication experience, and the overall competitiveness can be improved.

In one embodiment, the second antenna structure includes a second non-mm-wave antenna; the first mm-wave RFIC includes a first mm-wave RFIC main body and a first shielding case arranged at a periphery of the first mm-wave RFIC main body; the first shielding case is electrically connected to the second non-mm-wave antenna; and at least one of the first shielding case and the second non-mm-wave antenna is connected to a non-mm-wave antenna feed source assembly. By means of the first shielding case, the length and/or area of the non-mm-wave antenna of the antenna device can be effectively increased and/or enlarged, and the performance of the non-mm-wave antenna is improved. Furthermore, in the above embodiment, a path between the first mm-wave RFIC main body and the first mm-wave antenna is relatively short, so that the power loss on the path may be relatively small, that is, the radiation performance of the first mm-wave antenna can be improved.

In one embodiment, the antenna device includes a circuit board and an antenna stand; the antenna stand is arranged on the circuit board; and the second antenna structure is arranged on the antenna stand. The second antenna structure is arranged on the antenna stand on the circuit board, so that integration of the second mm-wave antenna and the second non-mm-wave antenna is realized, and the antenna stand effectively bears the second antenna structure; the antenna performance is improved by use of the height of the antenna stand; furthermore, the design flexibility of the antenna structure and the antenna device is increased; the challenge for disposing a number of antennas in the electronic apparatus is solved; and the space utilization rate is increased in a limited space, thereby improving the product competitiveness.

In one embodiment, the first antenna structure is arranged on the circuit board; the first shielding case is located between the first mm-wave antenna and the circuit board; and the first shielding case is further electrically connected to the circuit board. The first antenna structure is arranged on the circuit board, which is conductive to reducing the element cost and the assembling cost and improving the assembling efficiency and is also beneficial for the flexible structural design of the antenna device and an electronic apparatus system, such as the degree-of-freedom of the routing on the circuit board and the placement of device elements, thus improving the overall competitiveness of the product.

In one embodiment, the antenna device further includes a first conductive member; the first conductive member is electrically connected between the first shielding case and the circuit board and includes a first metal block; and the first metal block is arranged on the circuit board and is electrically connected to a ground line of the circuit board. By means of the first conductive member, the technical effects of isolation, supporting, electrical connection (such as grounding), heat dissipation, and the like can be achieved, and the overall competitiveness of the product is improved. Specifically, the first conductive member includes the first metal block, which not only plays a supporting role, but also discharges heat to the outside while it is grounded, so as to reduce the temperature of the antenna device (the mm-wave RFIC main body) and maintain the stability of a wireless communication function, thus improving the product performance and the grip comfort of a user.

In one embodiment, the first antenna structure further includes a base material and a first connector, the first mm-wave antenna, the first mm-wave RFIC, and the first connector are all arranged on the base material; the first connector is electrically connected to the first mm-wave RFIC main body; the first connector is further used to be electrically connected with an external device; the base material includes a first surface away from one side of the circuit board and a second surface close to one side of the circuit board; the first mm-wave antenna is arranged on the first surface; the first mm-wave RFIC and the first connector are arranged on the second surface in a manner of being spaced apart from each other, a pin of the first mm-wave RFIC main body penetrates through the first shielding case and is electrically connected to the first mm-wave antenna via an electrical connection member penetrating through the base material. By means of the first shielding case, the mm-wave RFIC main body can be protected from signal crosstalk, so the reliability is improved, and a relatively good wireless communication effect is achieved. In addition, it may also be convenient for the first connector to electrically connect the first mm-wave RFIC main body and/or the first mm-wave antenna to the circuit board, thus achieving the technical effects of convenient assembling, reliable signal transmission, improved placement degree-of-freedom of the mm-wave antenna, and the like. Furthermore, in the above embodiment, the path between the first mm-wave RFIC and the first mm-wave antenna is relatively short, so that the power loss on the path may be relatively small, that is, the radiation performance of the first mm-wave antenna can be improved.

In one embodiment, the first antenna structure includes the first non-mm-wave antenna; the first non-mm-wave antenna is electrically connected to the first shielding case; the first non-mm-wave antenna is arranged on the first surface and the second surface; a part of the first non-mm-wave antenna located on the first surface includes a plurality of first opening regions; the first mm-wave antenna includes a plurality of first mm-wave antenna units; and the plurality of first mm-wave antenna units are respectively arranged in the plurality of first opening regions and are spaced apart from the first non-mm-wave antenna. Since the first non-mm-wave antenna is electrically connected to the first shielding case, the length and/or area of the non-mm-wave antenna of the antenna device can be effectively increased and/or enlarged, and the performance of the non-mm-wave antenna is improved.

In one embodiment, the first mm-wave antenna is located on a first plane; the second mm-wave antenna is located on a second plane that is different from the first plane; the first plane is perpendicular to the second plane; and the first plane is perpendicular or parallel to a board surface of the circuit board. It can be understood that the first mm-wave antenna and the second mm-wave antenna re located on different planes, particularly planes that are perpendicular to each other, so that mutual coupling and signal crosstalk between two mm-wave antennas can be reduced, and radiative beam coverage can be increased to reduce dead zones for wireless communication, thus improving the communication quality.

In one embodiment, the antenna device further includes a second mm-wave RFIC; the second mm-wave RFIC is arranged on the second antenna structure and is located between the second antenna structure and the antenna stand; the second mm-wave RFIC is electrically connected to the second mm-wave antenna; the antenna device further includes a second connector, the second connector is arranged on the second antenna structure and is electrically connected to the second mm-wave RFIC and/or the second mm-wave antenna; the second connector and the second mm-wave RFIC are spaced apart from each other, the antenna stand has a first gap part; and at least part of the second connector is located in the first gap part and is used to be connected to another connector. It can be understood that the second mm-wave RFIC is arranged on the second antenna structure, which can increase the space utilization rate and can reduce the length of the path from the second mm-wave RFIC to the second mm-wave antenna, thus reducing the path loss and improving the wireless communication performance of the second mm-wave antenna. In addition, it may also be convenient for the second connector to electrically connect the second mm-wave RFIC main body and/or the second mm-wave antenna to the circuit board, thus achieving the technical effects of convenient assembling, reliable signal transmission, improved placement degree-of-freedom of the second mm-wave antenna, and the like. The design of the first gap part is conductive to connection of the second connector to another connector, thus achieving the technical effects of convenient assembling and reliable signal transmission, and the like.

In one embodiment, the antenna device further includes a second conductive member, the antenna stand has an opening; the antenna structure covers the opening; one end of the second conductive member is arranged on the circuit board, and the other end of the second conductive member passes through the opening and is connected to the second mm-wave RFIC; the mm-wave RFIC includes a second mm-wave RFIC main body electrically connected to the second mm-wave antenna and a second shielding case arranged outside the second mm-wave RFIC main body; the second conductive member includes a second metal block; the second metal block is electrically connected between the second shielding case and the ground line on the circuit board; and the second shielding case is further electrically connected to the second non-mm-wave antenna. By means of the opening and the second conductive member, the second conductive member can achieve the technical effects of isolation, supporting, electrical connection, heat dissipation, and the like. Specifically, the second conductive member includes the second metal block, which not only plays a supporting role, but also discharges heat to the outside while it is grounded, so as to reduce the temperature of the antenna device (the second mm-wave RFIC main body) and maintain the stability of a wireless communication function, thus improving the product performance and the grip comfort of a user. In addition, the second shielding case can protect the mm-wave RFIC main body from signal crosstalk, so the reliability is improved, and a relatively good wireless communication effect is achieved. In addition, in some embodiments, the second conductive member may be grounded and achieve an isolation effect; when the second shielding case and two ends of the second non-mm-wave antenna can be electrically connected to one non-mm-wave antenna feed source assembly, respectively, a radiation effect of two non-mm-wave antennas can be achieved, and even a MIMO effect can be achieved, without increasing the size of the antenna device. Therefore, the user experience of the antenna device is relatively high, and the overall competitiveness of the product is relatively high.

In one embodiment, the antenna stand includes an inner surface and an outer surface, and the second antenna structure is arranged on the outer surface; the flexible printed circuit board includes a third surface and a fourth surface located on a side opposite to the third surface; at least part of the second mm-wave antenna is arranged on the third surface; at least part of the second non-mm-wave antenna is arranged on the third surface; the second non-mm-wave antenna is arranged on the third surface; the second non-mm-wave antenna is further electrically connected to the non-mm-wave antenna feed source assembly on the circuit board, the third surface is a surface away from one side of the outer surface, and the fourth surface is a surface close to one side of the outer surface. At least part of the second mm-wave antenna and at least part of the second non-mm-wave antenna are arranged on the same surface, and at least part of the second mm-wave antenna and at least part of the second non-mm-wave antenna are arranged on the outer surface, so that a compact design of the antenna device can be realized, and the requirement of the antenna device for the overall size of the electronic apparatus is lowered, thus reducing the cost, improving the antenna performance, and the product competitiveness.

In one embodiment, the second non-mm-wave antenna includes a plurality of second opening regions, and the second mm-wave antenna includes a plurality of second mm-wave antenna units; and the plurality of second mm-wave antenna units are respectively arranged in the plurality of second opening regions. By the arrangement of the plurality of second mm-wave antenna units, the communication capability of the second mm-wave antenna can be improved to meet the usage requirement of the existing electronic apparatus for a plurality of mm-wave antennas. The plurality of second mm-wave antenna units are respectively arranged in the plurality of second opening regions, so that the second non-mm-wave antenna can effectively improve the mutual coupling and signal crosstalk between the plurality of second mm-wave antenna units, so as to improve the wireless communication performance. By means of the above arrangement, the antenna device can be designed to be more compact to increase the space utilization rate, thus improving the overall competitiveness of the product.

In one embodiment, one part of the second non-mm-wave antenna is arranged on the third surface, and the other part of the second non-mm-wave antenna is arranged on the fourth surface; the antenna stand includes an opening corresponding to the other part of the second non-mm-wave antenna; the antenna device includes a third conductive member, the third conductive member is arranged on the circuit board and contacts the other part of the second non-mm-wave antenna through the opening, so as to ground the other part of the second non-mm-wave antenna; the third conductive member includes a third metal block; the other part of the second non-mm-wave antenna includes a second intermediate part, a third antenna part, and a fourth antenna part; the third antenna part and the fourth antenna part are respectively connected to two ends of the second intermediate part; the second intermediate part is electrically connected to the third conductive member, each of the third antenna part and the fourth antenna part is electrically connected to one non-mm-wave antenna feed source assembly located on the circuit board; the third metal block has a second gap part; and at least part of the flexible printed circuit board passes through the second gap part and is superposed with and electrically connected to the circuit board. It can be understood that the third conductive member can achieve the technical effects of isolation, supporting, electrical connection, heat dissipation, and the like. Specifically, the third conductive member includes the third metal block, which not only plays a supporting role, but also discharges heat to the outside while it is grounded, so as to reduce the temperature of the antenna device (the mm-wave RFIC main body) and maintain the stability of a wireless communication function, thus improving the product performance and the grip comfort of the user. The third conductive member is grounded and achieves an isolation effect, so that each of two ends of one second non-mm-wave antenna can be electrically connected to one non-mm-wave antenna feed source assembly, thus achieving a radiation effect of two non-mm-wave antennas, and even achieving a MIMO effect, without increasing the size of the antenna device. Therefore, the user experience of the antenna device is relatively high, and the overall competitiveness of the product is relatively high.

In one embodiment, the antenna stand includes a first supporting part and a second supporting part; the second supporting part is connected with the circuit board; the first supporting part is connected to a side of the second supporting part away from the circuit board and is opposite to the circuit board; the flexible printed circuit board includes a first part and a second part connected to the first part; the first part is arranged on the first supporting part; at least part of the second part is arranged on the second supporting part and is connected to the circuit board; the second mm-wave antenna is arranged on the first part or the second part; and at least part of the second non-mm-wave antenna is arranged on the first part and the second part. It can be understood that the antenna stand having the first supporting part and the second supporting part can realize effective bearing for a three-dimensional antenna structure having the first part and the second part and increase the design flexibility of the antenna device. In addition, the three-dimensional antenna structure is also favorable for improving the antenna performance and the wireless communication experience.

In one embodiment, the first supporting part, the second supporting part, and the circuit board are further encircled to form an accommodating space; and the part of the circuit board that is encircled to form the accommodating space is provided with a non-mm-wave antenna feed source assembly. It can be understood that by means of designing the accommodating space, devices can be accommodated (such as an electronic apparatus on the circuit board), thus increasing the space utilization rate of the antenna device. Further, the non-mm-wave antenna feed source assembly is arranged on the part of the circuit board that is encircled to form the accommodating space, which is conductive to electrically connecting the antenna structure to the non-mm-wave antenna feed source assembly and reducing the loss of a transmission line, so as to improve the signal transmission effect.

In one embodiment, the antenna stand further includes a third supporting part; the third supporting part is connected to the first supporting part, the second supporting part, and the circuit board; the flexible printed circuit board includes a third part; the third part is connected to the first part or the second part and is arranged on the third supporting part; and at least part of the second non-mm-wave antenna is arranged on the third part and is electrically connected to the first shielding case. By means of the third supporting part, the effective bearing for the three-dimensional antenna structure is further enhanced, and the design flexibility of the antenna device is increased.

In one embodiment, the second part includes a first sub-part arranged on the second supporting part and a second sub-part connected to the first sub-part; the second sub-part is in bending connection with the first sub-part; the second sub-part is superposed with the circuit board and is connected with the circuit board; the antenna stand includes an opening part; the second sub-part passes through the opening part; and the second sub-part is electrically connected with the non-mm-wave antenna feed source assembly, the second mm-wave RFIC, and/or the ground line on the circuit board. The bent second sub-part is superposed with the circuit board and is connected with the circuit board, which can facilitate the electrical connection between the second part and an external device (such as the second mm-wave RFIC) and improve the assembling efficiency and can improve the compactness and extreme performance of system stacking.

In one embodiment, the antenna stand includes an opening part; and the second part is electrically connected to the non-mm-wave antenna feed source assembly via an electrical connection member passing through the opening part. The above-mentioned realization of the electrical connection through the electrical connection member can improve the flexibility of structural design of the antenna device.

In one embodiment, the antenna device further includes a housing; and at least part of the housing is electrically connected to the first non-mm-wave antenna and/or the second non-mm-wave antenna. At least part of the housing is electrically connected to the first and/or second non-mm-wave antenna, so that at least part of the housing can be used as an antenna at the same time, which helps to increase the length and/or enlarge the area of the antenna structure (particularly the length and/or area of a low-frequency non-mm-wave antenna), so as to improve the performance of the non-mm-wave antenna; furthermore, the housing is generally located on the outermost side of the electronic apparatus, which is also conductive to avoiding an antenna signal from being shielded or reducing the signal shielding, thus improving the antenna performance, the wireless communication experience of a user, and the overall competitiveness of a product.

In one embodiment, the housing includes a side wall structure annularly arranged at a periphery of the circuit board; the side wall structure includes a gap; at least part of the first antenna structure and/or at least part of the second antenna structure is located in the gap; the antenna device further includes a decorative member, at least part of the second mm-wave antenna and/or the second non-mm-wave antenna corresponds to the gap; and the decorative member is located in the gap and covers at least part of the second mm-wave antenna and/or the second non-mm-wave antenna. Since at least part of the second mm-wave antenna and/or the second non-mm-wave antenna corresponds to the gap, stable and reliable assembling of the antenna structure and the housing can be realized, and the gap can also avoid an antenna signal from being shielded or reduce the signal shielding, which enhances the wireless communication experience. Further, the decorative member can not only protect the antenna structure, avoid damage, and improve the reliability, but also improve the appearance beauty of the electronic apparatus using the antenna device and improve the product competitiveness.

In a second aspect, the present further disclosure discloses an electronic apparatus. The electronic apparatus includes the antenna device of any one of the above embodiments. The electronic apparatus uses the antenna device in the foregoing embodiments, so that it also has other further features and advantages of the antenna device, and descriptions thereof are omitted here.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

DETAILED DESCRIPTION OF THE EMBODIMENTS

Figure 1:
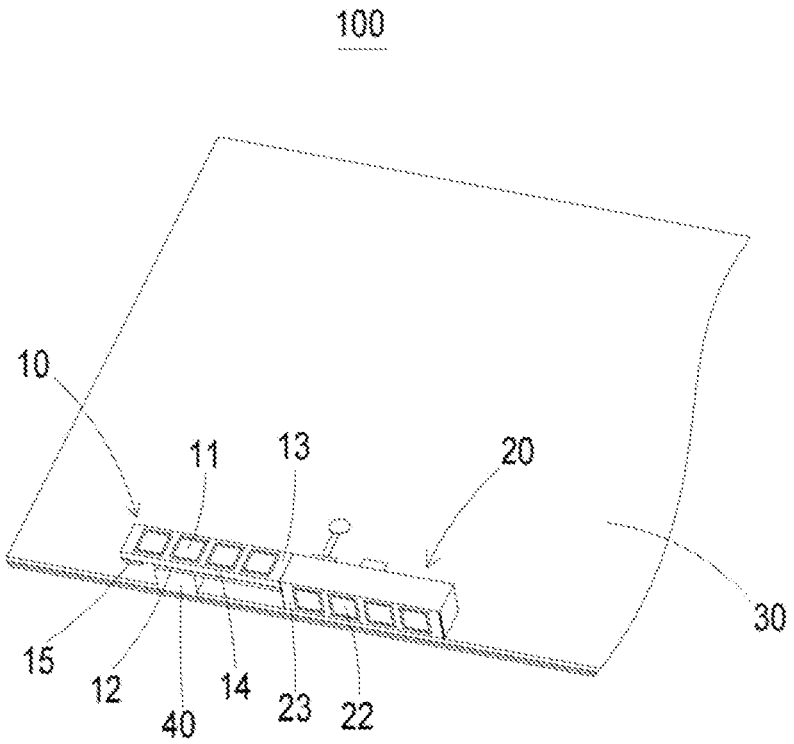
FIG. 1 is a three-dimensional diagram of an antenna device disclosed in Embodiment I of the present disclosure.
Figure 2:
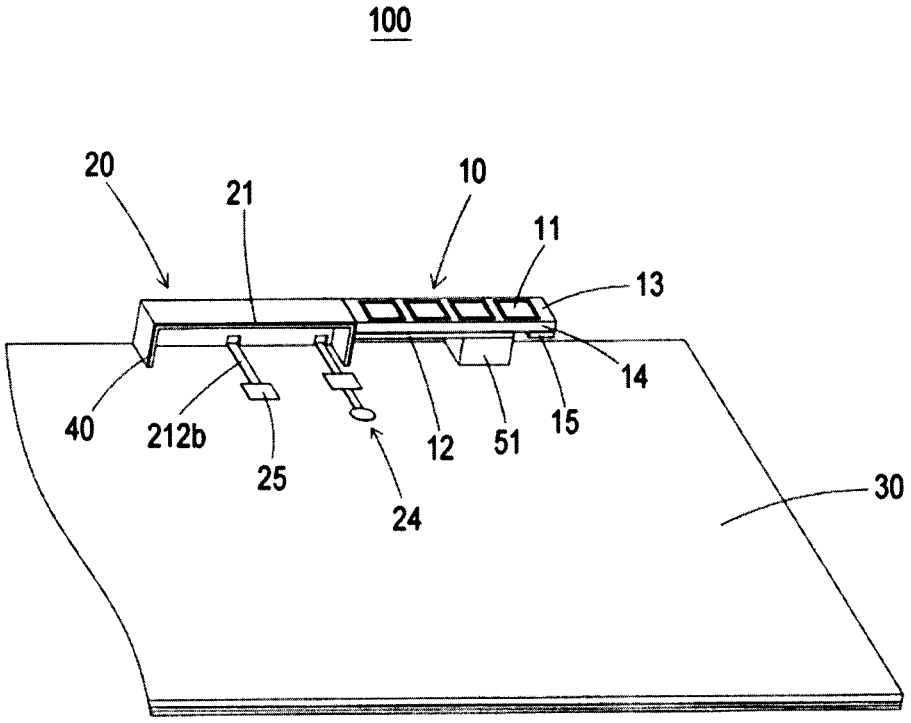
FIG. 2 is a three-dimensional diagram from another view of the antenna device shown in FIG. 1.
Figure 3:
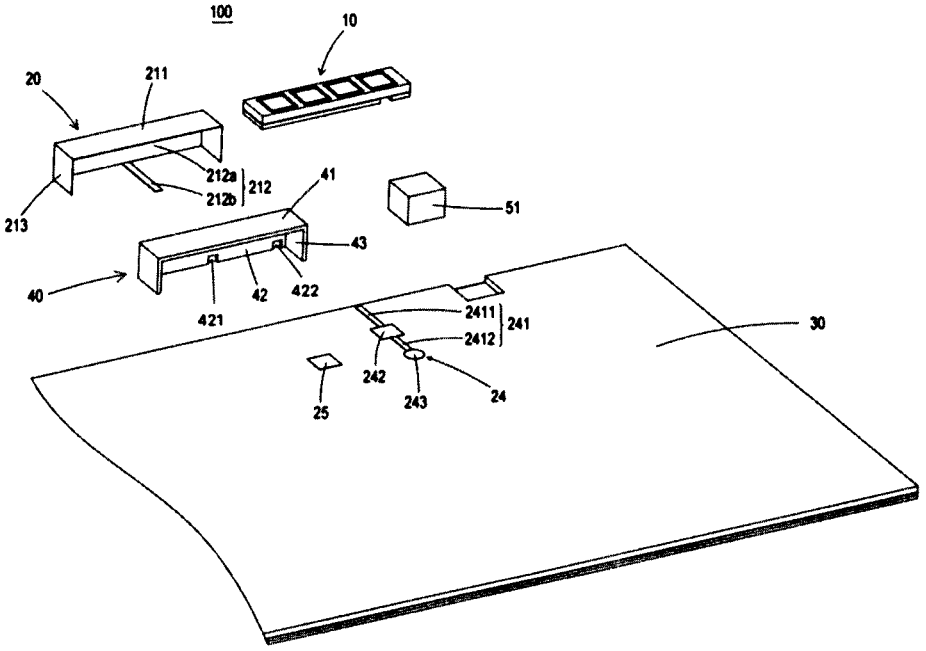
FIG. 3 is an exploded diagram of the antenna device of FIG. 1.

The technical solutions in the embodiments of the present disclosure will be clearly and completely described below in conjunction with the accompanying drawings in the embodiments of the present disclosure. Apparently, the described embodiments are only a part of the embodiments of the present disclosure, rather than all the embodiments. Based on the embodiments in the present disclosure, all other embodiments obtained by those of ordinary skill in the art without creative work shall fall within the protection scope of the present disclosure.

In the present disclosure, orientations or positional relationships indicated by the terms "upper", "lower", "left", "right", "front", "rear", "top", "bottom", "inner", "outer", "middle", "vertical", "horizontal", "transverse", "longitudinal", etc. are based on orientations or positional relationships shown in the drawings. These terms are mainly used to better describe the present disclosure and embodiments of the present disclosure, and are not used to limit that the indicated device, element, or component must have a specific orientation, or be constructed and operated in a specific orientation.

In addition, some of the above terms may be used to indicate other meanings in addition to the orientations or position relationships. For example, the term "upper" may also be used to indicate a certain dependence relationship or connection relationship in some cases. For those of ordinary skill in the art, the specific meanings of the above terms in the present disclosure can be understood according to specific situations.

In addition, the terms "install", "arrange", "provide", "connect" and "couple" should be understood broadly. For example, it can be a fixed connection, a detachable connection, an integral structure, a mechanical connection, an electrical connection, a direct connection, an indirect connection through an intermediate medium, or a communication between two devices, elements or components. For those of ordinary skill in the art, the specific meanings of the above terms in the present invention can be understood according to specific situations.

In addition, the terms "first", "second", etc., are used primarily to distinguish different devices, elements or components (the specific type and construction may be the same or different) and are not used to indicate or imply the relative importance or quantity of the indicated device, element or component. Unless otherwise stated, "plurality" means two or more.

Embodiment I

Referring to FIG. 1 to FIG. 7, Embodiment I of the present disclosure provides an antenna device 100 used in an electronic apparatus. The antenna device 100 includes a first antenna structure 10 and a second antenna structure 20. The first antenna structure 10 includes a first millimeter wave (mm-wave) antenna 11 and a first mm-wave radio-frequency integrated circuit (RFIC) 12 electrically connected to the first mm-wave antenna 11. The second antenna structure 20 includes a flexible printed circuit board 21, a second mm-wave antenna 22 arranged on the flexible printed circuit board 21, and a second non-mm-wave antenna 23 arranged on the flexible printed circuit board 21.

Compared to the existing art, the antenna device 100 includes the first antenna structure 10 and the second antenna structure 20, and the second mm-wave antenna 20 integrates the second mm-wave antenna 22 with the non-mm-wave antenna, which is conductive to solving the challenge for disposing a number of antennas in the above-mentioned 5G mobile phone; a higher space utilization rate is achieved under a limited space; and the antenna performance, the antenna communication experience, and the overall competitiveness can be improved.

Figure 4:
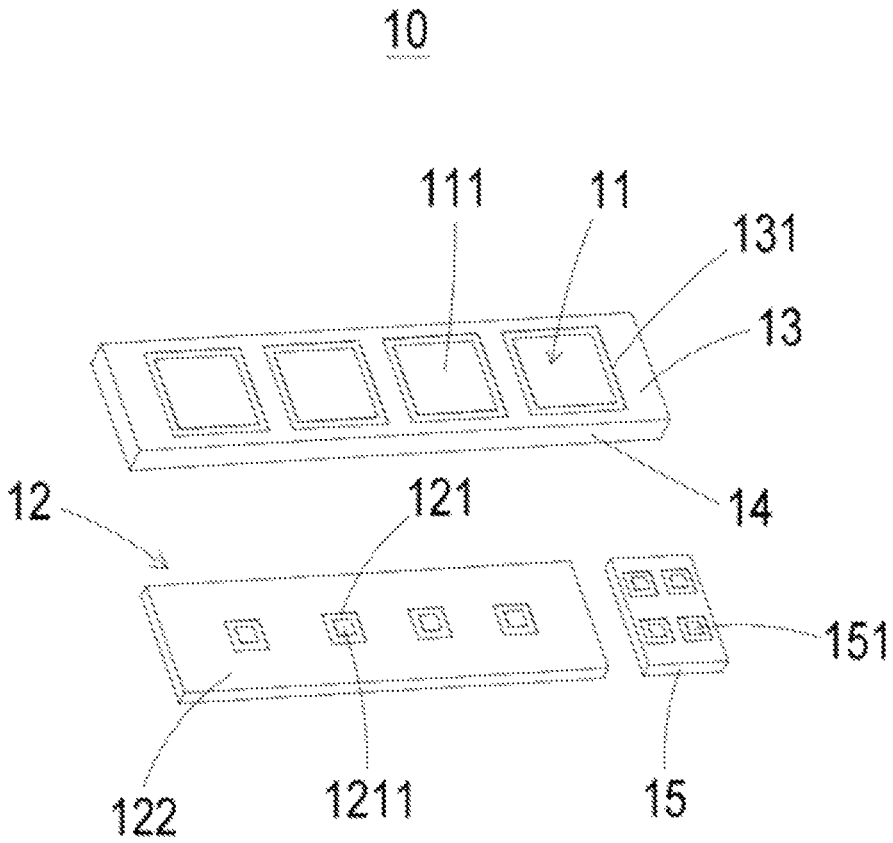
FIG. 4 is an exploded diagram of a first antenna structure of the antenna device shown in FIG. 1.
Figure 5:
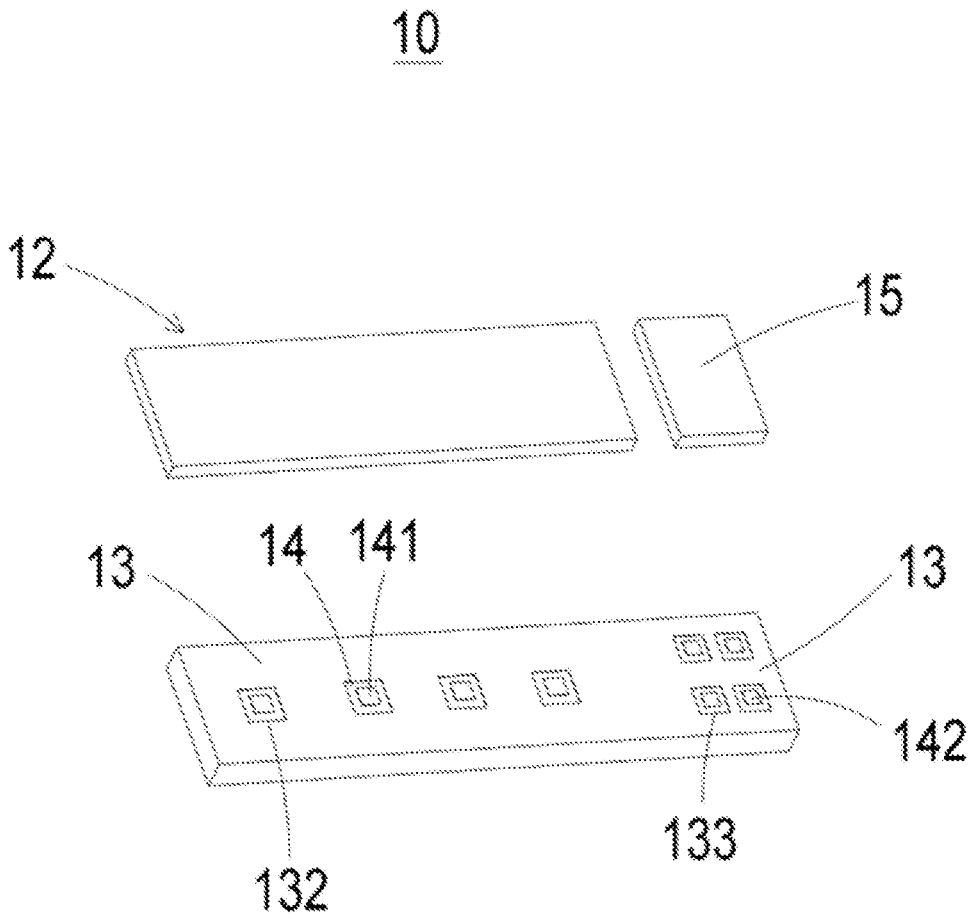
FIG. 5 is a schematic diagram from another view of the first antenna structure shown in FIG. 4.

As shown in FIG. 4 and FIG. 5, the first mm-wave RFIC 12 may include a first mm-wave RFIC main body 121 and a first shielding case 122 arranged at a periphery of the first mm-wave RFIC main body 121. The first mm-wave RFIC main body 121 is electrically connected to the first mm-wave antenna 11; and the first shielding case 122 is electrically connected to the second non-mm-wave antenna 23. Specifically, at least part of the first shielding case 122 may be a conductor, which can protect the first mm-wave RFIC main body 121 from signal crosstalk, thus improving the reliability of the first antenna structure 10 and achieving a better radiation effect. It can be understood that the first mm-wave RFIC main body 121 is a chip main body part of the mm-wave RFIC, and the first shielding case 122 is a metal shielding case.

The first antenna structure 10 further includes a first non-mm-wave antenna 13, a base material 14, and a first connector 15; the first mm-wave antenna 11, the first non-mm-wave antenna 13, the first mm-wave RFIC 12, and the first connector 15 are all arranged on the base material 14; the first connector 15 is electrically connected to the first mm-wave RFIC 12 and/or the first mm-wave antenna 11 through the base material 15; and the first connector 15 is further used to be electrically connected with an external device.

Specifically, the first mm-wave antenna 11 is arranged on the first surface of the base material 14 away from the first mm-wave RFIC 12; the first mm-wave RFIC 12 and the first connector 15 are arranged on the second surface of the base material 14 away from the first mm-wave antenna 11 in a manner of being spaced apart from each other, the first shielding case 122 is arranged at the periphery of the first mm-wave RFIC main body 121; a pin 1211 of the first mm-wave RFIC main body 121 penetrates through the first shielding case 122, so as to be electrically connected to the first mm-wave antenna 11 via the base material 14. It can be understood that the first shielding case 122 is a conductor, and the first shielding case 122 may be electrically connected with the first non-mm-wave antenna 13 and may also be electrically connected with the second non-mm-wave antenna 23. In particular, the first shielding case 122 may be electrically connected with the first non-mm-wave antenna 13 by means of direct contact and may also be electrically connected with the second non-mm-wave antenna 23 by means of direct contact. By means of the first shielding case 122, the length and/or area of the non-mm-wave antenna of the antenna device 100 can be effectively increased and/or enlarged, and the performance of the non-mm-wave antenna is improved. Furthermore, the path between the first mm-wave RFIC main body 121 and the first mm-wave antenna 11 is relatively short, so that the power loss on the path may be relatively small, that is, the radiation performance of the first mm-wave antenna 11 can be improved.

The first non-mm-wave antenna 13 may be arranged on the first surface and the second surface of the base material 14; the first non-mm-wave antenna 13 located on the first surface of the base material 14 may have a plurality of first opening regions 131; the first mm-wave antenna includes a plurality of first mm-wave antenna units 111; and the plurality of first mm-wave antenna units 111 are respectively located in the plurality of first opening regions 131. By the arrangement of the plurality of first mm-wave antenna units 111, the communication capability of the first mm-wave antenna 11 can be improved to meet the usage requirement of the existing electronic apparatus for a plurality of mm-wave antennas. The plurality of first mm-wave antenna units 111 are respectively arranged in the plurality of first opening regions 131, so that the first non-mm-wave antenna 13 can effectively improve the mutual coupling and signal crosstalk between the plurality of first mm-wave antenna units 111 and improve the radiation effect. By means of the above arrangement, the antenna device 100 can be designed to be more compact to increase the space utilization rate, thus improving the overall competitiveness of the product.

In particular, the base material 14 may have a first via hole 141 that is perforative; the pin 1211 of the first mm-wave RFIC main body 121 is electrically connected to the first mm-wave antenna 11 via the first via hole 141. A pin 151 of the first connector 15 may be electrically connected to the first mm-wave RFIC main body 121 and/or the first mm-wave antenna 11 via the base material 14. Specifically, the base material 14 may have a connection line 142. The connection line 142 may be electrically connected to the pin 151 of the first connector 15 and the first mm-wave RFIC main body 121 and/or the first mm-wave antenna 11. Further, the first non-mm-wave antenna 13 may be provided with a first avoiding region 132 and a second avoiding region 133 so that the first via hole 141 may be exposed via the first avoiding region 132, so as to facilitate the electrical connection between the first via hole 141 and the first mm-wave RFIC main body 121; and the connection line 142 may be exposed via the second avoiding region 133, so as to facilitate the electrical connection between the connection line 142 and the first connector 15.

The antenna device 100 further includes a circuit board 30. The first antenna structure 10 and the second antenna structure 20 are both arranged on the circuit board 30. The circuit board 30 may be a main board of the electronic apparatus. It may specifically be a printed circuit board. The second antenna structure 20 and the first antenna structure 10 may be disposed side by side, and the first antenna structure 10 may be connected with the second antenna structure 20. Specifically, the first non-mm-wave antenna 13 of the first antenna structure 10 and the second non-mm-wave antenna 23 of the second antenna structure 20 may be electrically connected, so that the entire non-mm-wave antenna of the antenna device 100 has a relatively large electrical length or it is helpful for the design of a new antenna form, so as to improve the antenna performance, the wireless communication experience of a user, and the overall competitiveness. Specifically, extension of the electrical length of the non-mm-wave antenna can be realized by means of the direct contact between the first shielding case 122 of the first antenna structure 10 and the second non-mm-wave antenna 23 of the second antenna structure 20.

The antenna device 100 further includes a first conductive member 51 arranged on the circuit board 30. The first antenna structure 10 may be electrically connected with the circuit board 30 through the first conductive member 51. For example, the first non-mm-wave antenna 13 of the first antenna structure 10 may be electrically connected to the ground line on the circuit board 30 via the first shielding case 122 and the first conductive member 51. In this embodiment, the first conductive member 51 is a first metal block; the first metal block may support the first antenna structure 10, so that the first antenna structure 10 and the circuit board 30 have an interval space and heat of the first mm-wave RFIC 12 can be led out to facilitate heat dissipation of the first antenna structure, reduce the temperature of the antenna device 100 (the first mm-wave RFIC main body 121) and maintain the stability of a wireless communication function, thus improving the product performance and the grip comfort of the user. In this embodiment, the first antenna structure 10 is located on a side of the first conductive member 51 away from the circuit board 30, and the first conductive member 51 is electrically connected and supported to the first shielding case 122 and the circuit board 30.

That is, the first conductive member 51 may achieve the technical effects of supporting, electrical connection (such as grounding or connection to the non-mm-wave antenna feed source assembly), heat dissipation, and the like. Further, the first conductive member 51 may be connected between the first shielding case 122 and the ground line of the circuit board 30, so that the first shielding case 122 is grounded. In some other embodiments, the first conductive member 51 may also be connected between the first shielding case 122 and the non-mm-wave antenna feed source assembly. In some other embodiments, when the first conductive member 51 is connected between the first shielding case 122 and the ground line of the circuit board 30, each of two ends of the first shielding case 122 may be connected with one non-mm-wave antenna feed source assembly. At this time, the first conductive member 51 plays an isolation role, and the first shielding case 122 may achieve a radiation effect of two non-mm-wave antennas, without increasing the size of the antenna device 100, so that the user experience of the antenna device 100 is higher.

The antenna device 100 further includes an antenna stand 40. The antenna stand 40 is arranged on the circuit board 30, and the second antenna structure 20 is arranged on the antenna stand 40.

The antenna stand 40 is an insulating stand. It may be made of an insulating material or formed by covering a non-insulating material with an insulating material, for example. The antenna stand 40 includes an inner surface and an outer surface, and the second antenna structure 20 is arranged on the outer surface. In particular, the second antenna structure 20 is arranged on the outer surface, which can improve the radiation effect of the second antenna structure 20.

Specifically, the antenna stand 40 may include a first supporting part 41 and a second supporting part 42; the second supporting part 42 is connected with the circuit board 30; and the first supporting part 41 is connected to a side of the second supporting part 42 away from the circuit board 30 and is opposite to the circuit board 30. The first supporting part 41, the second supporting part 42, and the circuit board 30 are further encircled to form an accommodating space. The accommodating space can be used to accommodate internal and external devices, particularly electronic devices (such as a non-mm-wave antenna feed source assembly 24, a second mm-wave RFIC 25 or other devices) located on the circuit board 30, thereby increasing the space utilization rate of the antenna device 100. The non-mm-wave antenna feed source assembly 24 is arranged on the part of the circuit board 30 that is encircled to form the accommodating space, which is conductive to electrically connecting the second antenna structure 20 to the non-mm-wave antenna feed source assembly 24 and reducing the loss of a transmission line, so as to improve the signal transmission effect. The second mm-wave RFIC 25 is arranged on the part of the circuit board 30 that is encircled to form the accommodating space, which is conductive to electrically connecting the second antenna structure 22 to the second mm-wave RFIC 25 and reducing the loss of the transmission line, so as to improve the signal transmission effect.

In this embodiment, both the first supporting part 41 and the second supporting part 42 are flat supporting plates, and the first supporting part 41 is perpendicular to the second supporting part 42; and the first supporting part 41 and a board surface 302 of the circuit board 30 may be parallel to each other. The base material 14 may also be a flat structure; the base material 14 may be parallel to the board surface 302 of the circuit board 30; and the first mm-wave antenna 11 may be located on a first plane, and the second mm-wave antenna 22 may be located on a second plane that is different from the first plane. Specifically, the first plane and the second plane may be perpendicular to each other, but are not limited to being perpendicular to each other, and they may also be in a preset angle. Specifically, the first plane may be parallel to the board surface 302 of the circuit board 30, and the second plane may be perpendicular to the board surface 302 of the circuit board 30. The first plane and the second plane are perpendicular to each other, which is beneficial to reducing mutual coupling and signal crosstalk between the first mm-wave antenna 11 and the second mm-wave antenna 22 and can increase the radiative beam coverage to reduce dead zones for wireless communication, thus improving the communication quality.

Figure 6:
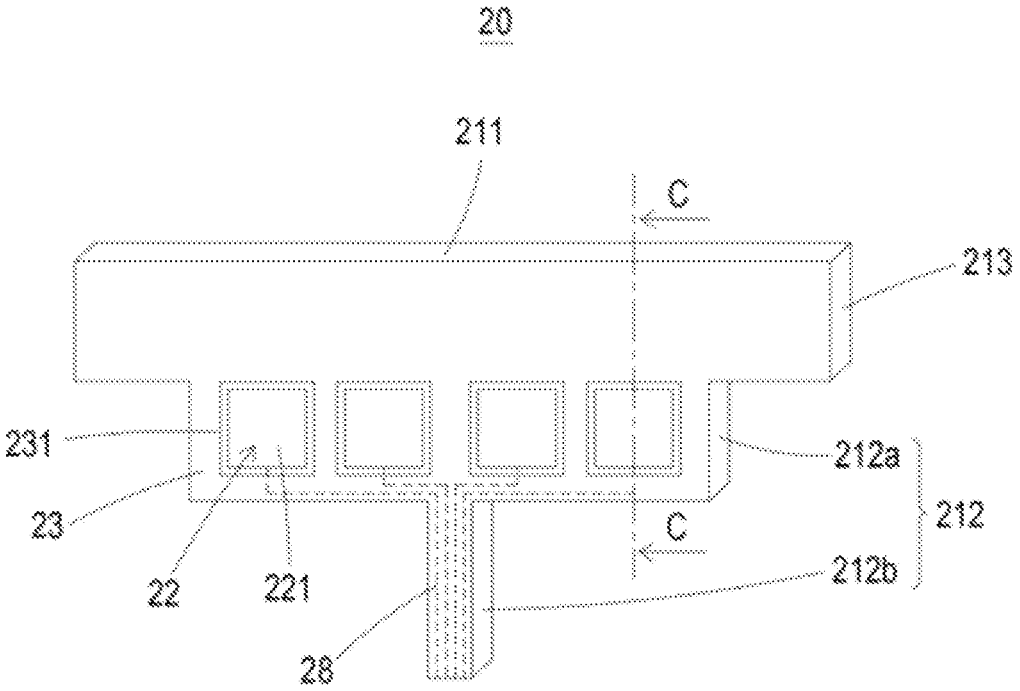
FIG. 6 is a three-dimensional diagram illustrating that a second antenna structure of the antenna device shown in FIG. 1 is in a spread state.
Figure 7:
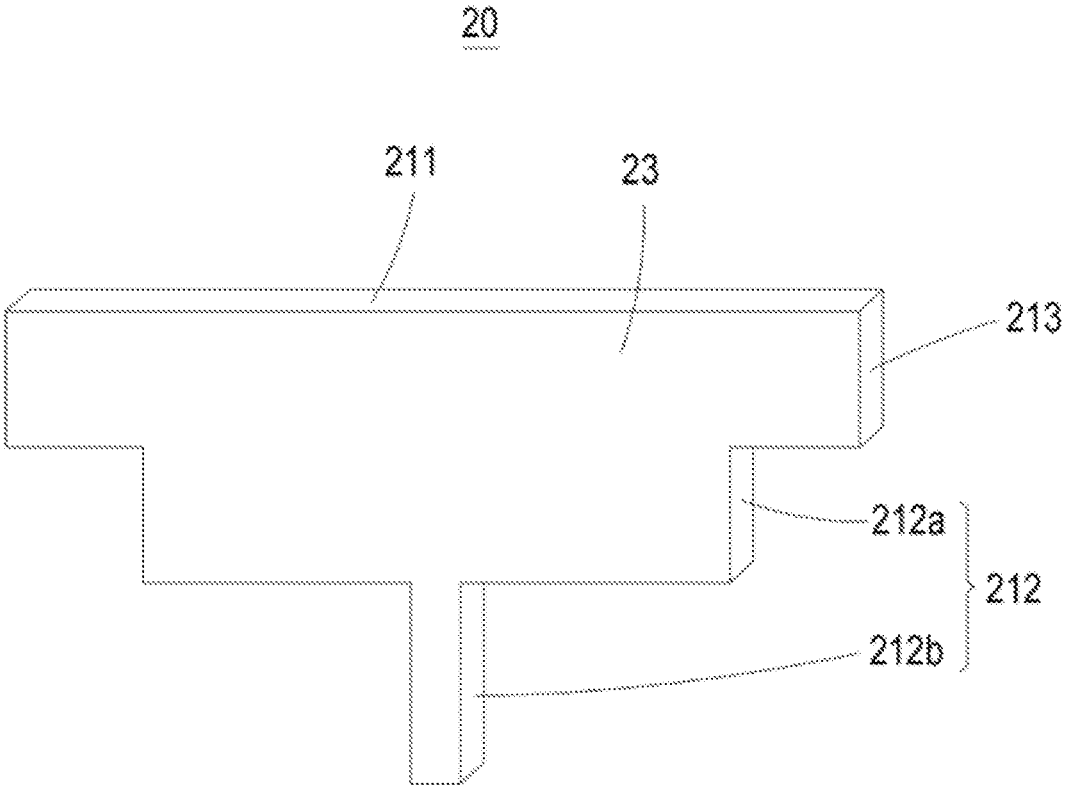
FIG. 7 is a three-dimensional diagram from another view of the second antenna structure shown in FIG. 6.

As shown in FIG. 6 to FIG. 7, in the second antenna structure 20, the flexible printed circuit board 21 includes a first part 211 and a second part 212 connected to the first part 211; the first part 211 is arranged on the first supporting part 41; and at least part of the second part 212 is arranged on the second supporting part 42 and is connected to the circuit board 30. The second mm-wave antenna 22 may be arranged on the first part 211 or may be arranged on the second part 212. In this embodiment, schematic illustration is mainly made by taking a case that the second mm-wave antenna 22 is arranged on the second part 212 as an example.

At least part of the second non-mm-wave antenna 23 may be arranged on the first part 211 and the second part 212. It can be understood that the antenna stand 40 having the first supporting part 41 and the second supporting part 42 can realize effective bearing for a three-dimensional antenna structure having the first part 211 and the second part 212 and increase the design flexibility of the antenna device 100. In addition, the three-dimensional antenna structure is also favorable for improving the antenna performance and the wireless communication experience. The second non-mm-wave antenna 23 is also used to be electrically connected to the non-mm-wave antenna feed source assembly 24, and the non-mm-wave antenna feed source assembly 24 may be arranged on the circuit board 30. For example, at least part of the non-mm-wave antenna feed source assembly may be located in the accommodating space formed by encircling the first supporting part 41, the second supporting part 42, and the circuit board 30. This is conductive to reducing the length of a feeder line and increasing the space utilization rate.

In this embodiment, the antenna stand 40 further includes a third supporting part 43; the third supporting part 43 is connected to the first supporting part 41, the second supporting part 42, and the circuit board 30; the flexible printed circuit board 21 includes a third part 213; the third part 213 is connected to the first part 211 and/or the second part 212 and is arranged on the third supporting part 43; and at least part of the second non-mm-wave antenna 23 is arranged on the third part 213. By means of the third supporting part 43, the effective bearing for the three-dimensional antenna structure is further enhanced, and the design flexibility of the antenna device 100 is increased. It can be understood that in Embodiment I, the third part 213 located on the outer side of the third supporting part 43 may directly contact the first shielding case 122 of the first antenna structure 10, so that part of the second non-mm-wave antenna 23 on a surface of the third part 213 directly contacts and is electrically connected to the first shielding case 122, and the second non-mm-wave antenna 23 is electrically connected to the first non-mm-wave antenna 13 of the first antenna structure 10 via the first shielding case 122.

The second part 212 includes a first sub-part 212*a* arranged on the second supporting part 42 and a second sub-part 212*b* connected to the first sub-part 212*a*; the second sub-part 212*b* and the first sub-part 212*a* are in bending connection; the second sub-part 212*b* is superposed with the circuit board 30 and is connected with the circuit board 30; the circuit board 30 is provided with a second mm-wave RFIC 25; the second sub-part 212*b* is electrically connected with the second mm-wave RFIC 25 so that the second mm-wave antenna 22 is electrically connected to the mm-wave RFIC 25. The bent second sub-part 212*b* is superposed with the circuit board 30 and is connected with the circuit board 30, which can facilitate the electrical connection between the second part 212 and an external device (such as the second mm-wave RFIC 25) and improve the assembling efficiency and can improve the compactness and extreme performance of system stacking. It can be understood that the second mm-wave RFIC 25 may be of the basically same structure as that of the first mm-wave RFIC 12, and may also include a mm-wave RFIC main body and a shielding case arranged at a periphery of the mm-wave RFIC main body. Its specific structure will not be described repeatedly here.

Further, the second supporting part 42 may have a first opening part 421 and a second opening part 422. The second sub-part 212*b* may pass through the first opening part 421, and one end of the second sub-part 212*b* away from the first sub-part 212*a* is electrically connected to the circuit board 30, such as the second mm-wave RFIC 25 on the circuit board 30. The arrangement of the first opening part 421 can facilitate the bending of the second sub-part 212*b* relative to the first sub-part 212*a*; after the bending, the bottom of the second sub-part 212*b* and the bottom of the first sub-part 212*a* can be substantially located on the same plane, thereby favorably improving the assembling flatness of the second antenna structure 20. Part of the second non-mm-wave antenna 23 of the second antenna structure 20 (such as part of the second non-mm-wave antenna 23 located on a surface of a side of the flexible printed circuit board 21 away from the second mm-wave antenna 22) is exposed via the second opening part 422, and the second non-mm-wave antenna 23 may be electrically connected, via the second opening part 422, to the non-mm-wave antenna feed source assembly 24 located on the circuit board 30.

The non-millimeter wave antenna feed source assembly 24 can include a feeder line 241, a matching network 242, and a feed source 243. The second non-millimeter wave antenna 23 is connected with the matching network 242 and the feed source 243 in sequence via the feeder line 241. In particular, the feeder line 241 may include a first feeder line 2411 and a second feeder line 2412; the first feeder line 2411 is connected with the matching network 242 and the feed source 243; one end of the second feeder line 2412 is connected with the matching network 242, and the other end of the second feeder line 2412 is connected with the second non-mm-wave antenna 23 via the second opening part 422; and the non-mm-wave antenna 23 is connected with the feed source 243 via the second feeder line 2412, the matching network 242, and the first feeder line 2411. In some change embodiments, some other cables or electrical connection members can also be used to replace the feeder line 241 to realize the electrical connection between the second non-mm-wave antenna 23, the matching network 242, and the feed source 243.

In this embodiment, the second opening part 422 is located at an end of the second supporting part 42 of the antenna stand 40 close to the first antenna structure 10, and the non-mm-wave antenna feed source assembly 24 is close to the first antenna structure 10.

Figure 8:
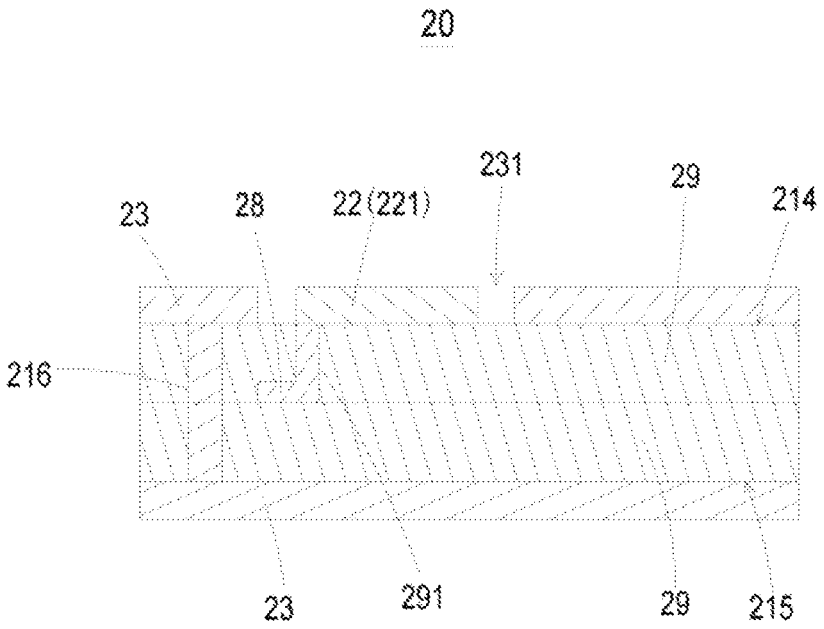
FIG. 8 is a schematic sectional diagram of the second antenna structure shown in FIG. 6 along line C-C.
Figure 9:
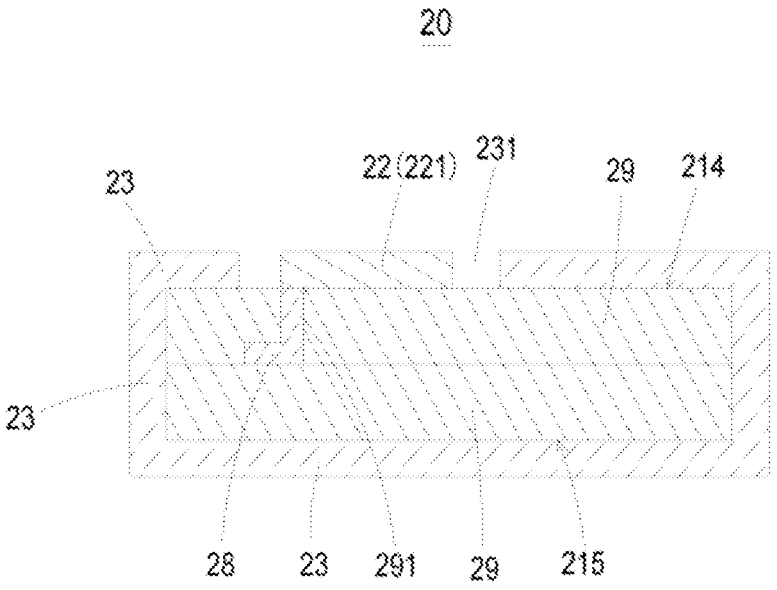
FIG. 9 is a schematic sectional diagram of a second antenna structure of one change embodiment of the antenna device shown in FIG. 1.

As shown in FIG. 6 to FIG. 8, the flexible printed circuit board 21 includes a third surface 214 and a fourth surface 215 located on a side opposite to the third surface 214; at least part of the second mm-wave antenna 22 is arranged on the third surface 214; and at least part of the second non-mm-wave antenna 23 is arranged on the fourth surface 215. The third surface 214 may be a surface away from one side of the outer surface of the antenna stand 40, and the fourth surface 215 is a surface close to one side of the outer surface of the antenna stand 40. In this embodiment, the fourth surface 215 is further provided with part of the second non-mm-wave antenna 23, and the part of the second non-mm-wave antenna 23 arranged on the third surface 214 and the part of the second non-mm-wave antenna 23 arranged on the fourth surface 215 may be electrically connected by means of a second via hole 216 penetrating through the flexible printed circuit board 21. However, as shown in FIG. 9, in one change embodiment, the part of the second non-mm-wave antenna 23 arranged on the third surface 214 and the part of the second non-mm-wave antenna 23 arranged on the fourth surface 215 may be connected into a whole through the part of the second non-mm-wave antenna 23 arranged on a side surface of the flexible printed circuit board 21 or are electrically connected together in other electrical connection ways, which is not limited to the above ways.

In particular, by means of disposing at least part of the second mm-wave antenna 22 and at least part of the second non-mm-wave antenna 23 on the same surface of the flexible printed circuit board 21, a compact design of the antenna device 100 can be realized, and the requirement of the antenna device 100 for the overall size of the electronic apparatus is lowered, thus reducing the cost and improving the antenna performance and the product competitiveness. Further, when at least part of the second mm-wave antenna 22 and at least part of the second non-mm-wave antenna 23 are located on the third surface 214 of the flexible printed circuit board 21 and are close to an outer side of the electronic apparatus, the antenna device further has a technical effect of good radiation effect.

The second non-mm-wave antenna 23 located on the third surface 214 may include a plurality of second opening regions 231, and the second mm-wave antenna 22 includes a plurality of second mm-wave antenna units 221. The plurality of second mm-wave antenna units 221 are respectively arranged in the plurality of second opening regions 231. By means of the above arrangement, the antenna device 100 may be designed to be more compact to increase the space utilization rate, and this is also conductive to reducing the interference between the second mm-wave antenna 22 and the second non-mm-wave antenna 23 and reducing the crosstalk between signals of the mm-wave antenna 22, thereby improving the overall competitiveness of the product.

Further, the flexible printed circuit board 21 is further provided with a first conductive line 28; one end of the first conductive line 28 is electrically connected to the second mm-wave antenna 22, and the other end of the first conductive line 28 is used to be electrically connected to the second mm-wave RFIC 25. It can be understood that the first conductive line 28 may be arranged on the second part 212. Specifically, in this embodiment, the first conductive line 28 may be arranged on the first sub-part 212*a* and extends onto the second sub-part 212*b*, thus the second sub-part 212*b* is electrically connected to the second mm-wave RFIC 25. It can be understood that in some embodiments, the circuit board 30 may also be provided with a feeder line, and the second sub-part 212*b* may be electrically connected to the second mm-wave RFIC 25 through the feeder line.

In particular, as shown in FIG. 8 and FIG. 9, the flexible printed circuit board 21 may include at least two insulating layers 29 that are stacked; the first conductive line 28 may be located between the two insulating layers 29 and is electrically connected to the second mm-wave antenna 22 by means of a third via hole 291 penetrating through one of the insulating layers 29.

Embodiment II

Figure 10:
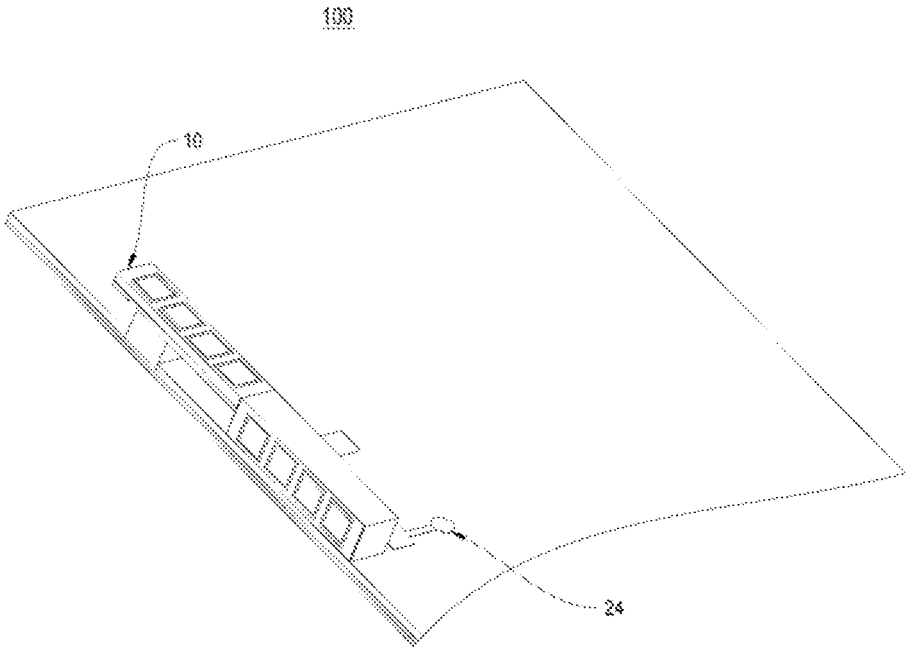
FIG. 10 is a three-dimensional diagram of an antenna device disclosed in Embodiment II of the present disclosure.
Figure 11:
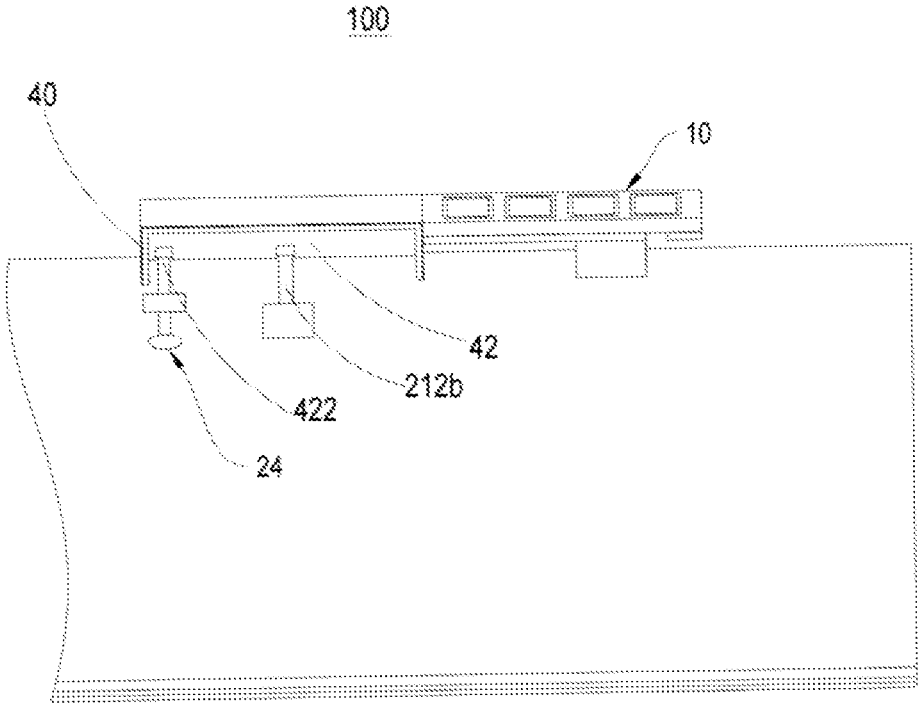
FIG. 11 is a three-dimensional diagram from another view of the antenna device shown in FIG. 10.
Figure 12:
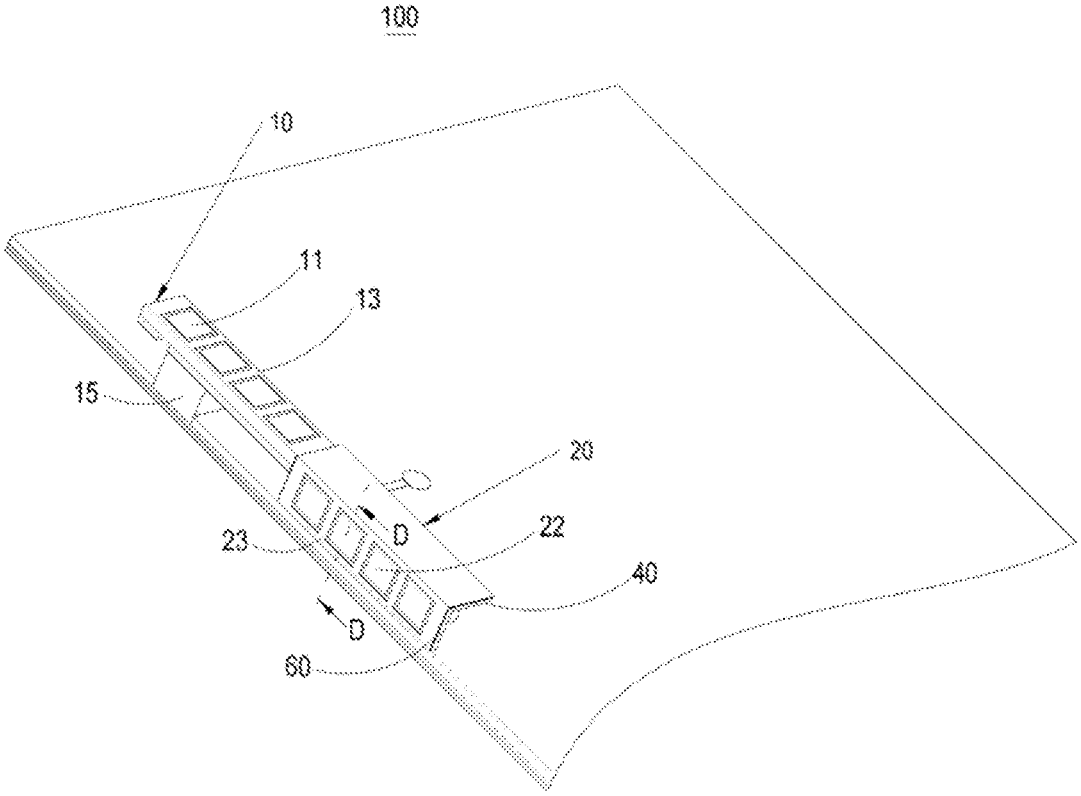
FIG. 12 is a three-dimensional diagram of an antenna device disclosed in Embodiment III of the present disclosure.
Figure 13:
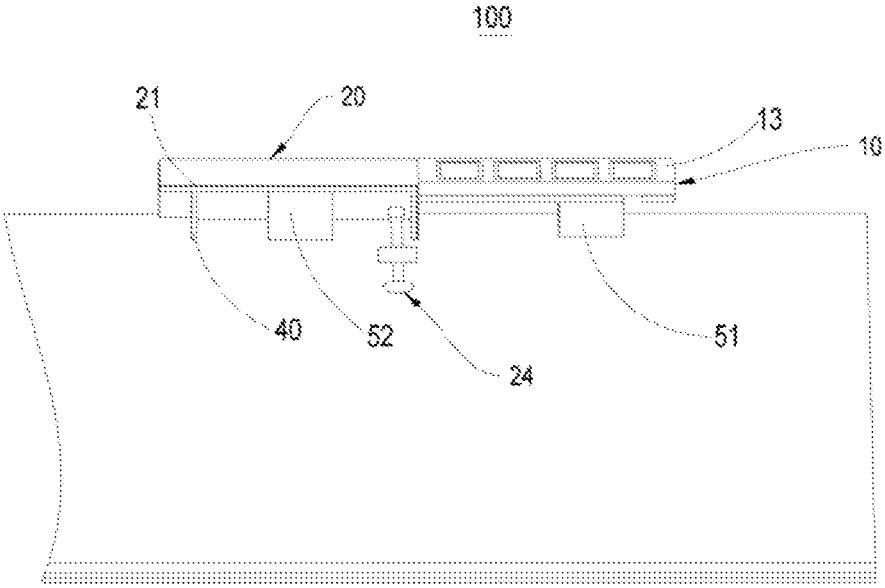
FIG. 13 is a three-dimensional diagram from another view of the antenna device shown in FIG. 12.
Figure 14:
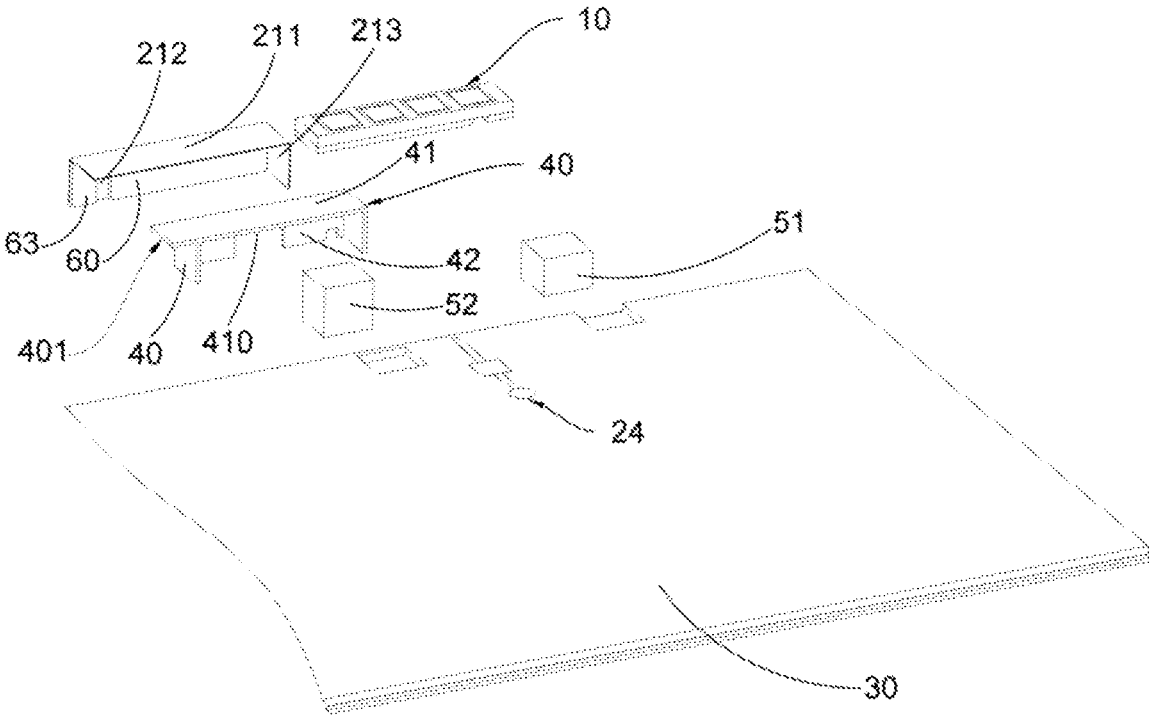
FIG. 14 is an exploded diagram of the antenna device of FIG. 12.
Figure 15:
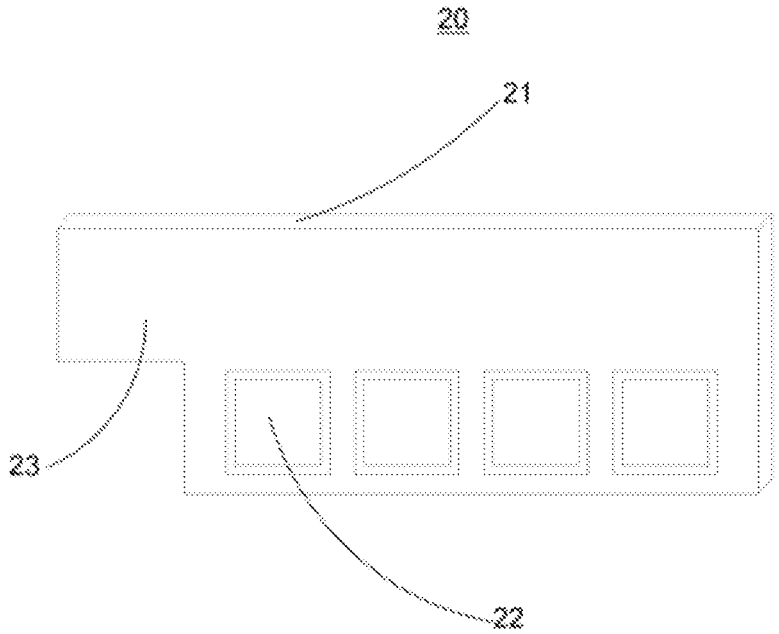
FIG. 15 is a three-dimensional diagram illustrating that a second antenna structure of the antenna device shown in FIG. 12 is in a spread state.
Figure 16:
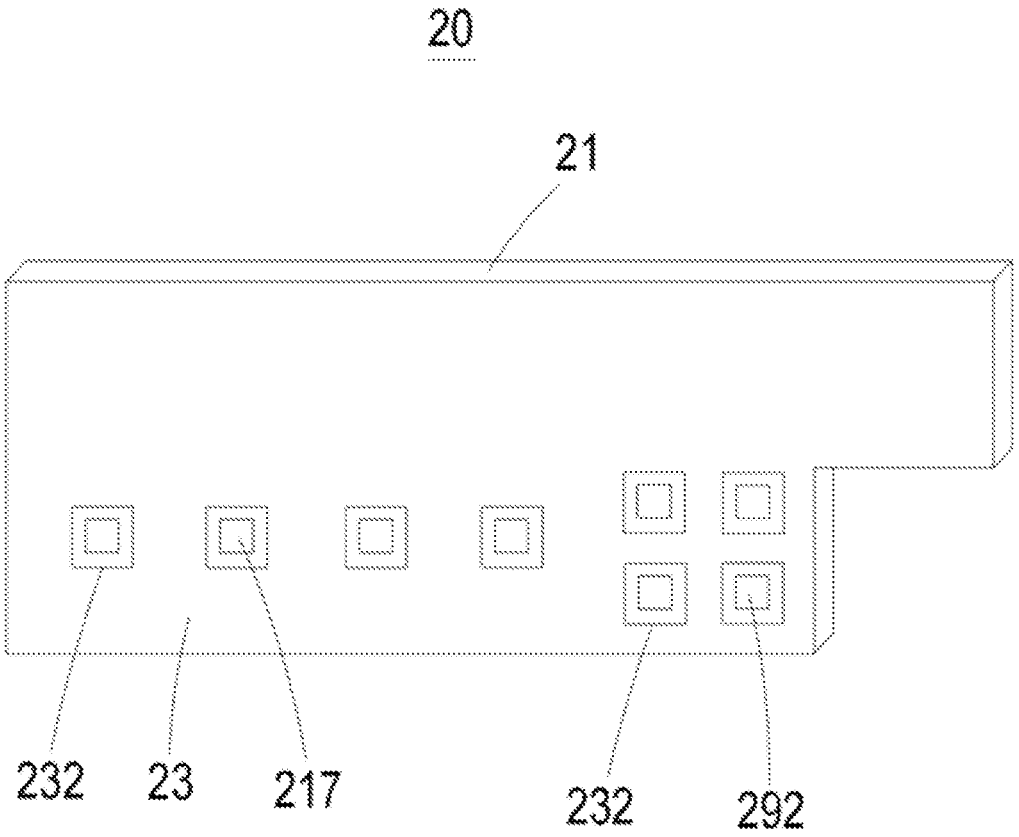
FIG. 16 is a three-dimensional diagram from another view of the second antenna structure shown in FIG. 15.
Figure 17:
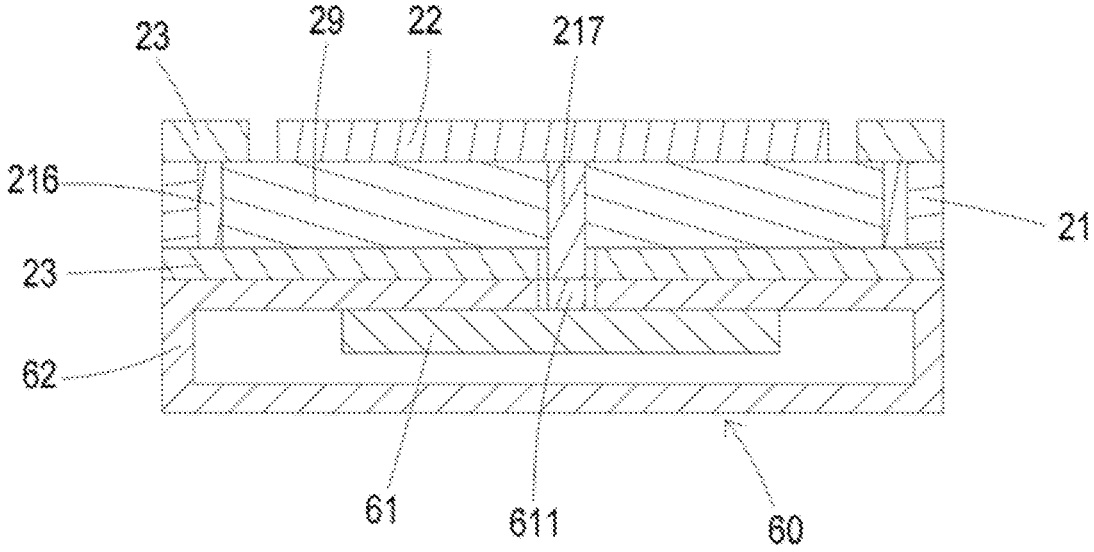
FIG. 17 is a schematic sectional diagram of the second antenna structure shown in FIG. 15 along line D-D.

Referring to FIG. 10 and FIG. 11, parts, which are the same as those of the antenna device 100 in Embodiment I, of the antenna device 100 in this embodiment are not repeatedly described, and descriptions of differences between the antenna device 100 in this embodiment and the antenna device 100 in Embodiment I will be emphasized.

In Embodiment II, the second opening part 422 is located at an end of the second supporting part 42 of the antenna stand 40 away from the first antenna structure 10; the non-mm-wave antenna feed source assembly 24 is farther from the first antenna structure 10 than the second sub-part 212*b*; and the second sub-part 212*b* is located between the non-mm-wave antenna feed source assembly 24 and the first antenna structure 10. It can be understood that the position design of the second opening part 422 and the non-mm-wave antenna feed source assembly 24 in Embodiment II is conductive to reducing the interference between signals and improving the communication quality and beneficial to the flexible structural design of the antenna device 100, thereby improving the overall competitiveness of the product.

Embodiment III

Referring to FIG. 12 to FIG. 17, parts, which are the same as those of the antenna device 100 in Embodiment I, of the antenna device 100 in this embodiment are not repeatedly described, and descriptions of differences between the antenna device 100 in this embodiment and the antenna device 100 in Embodiment I will be emphasized.

In Embodiment III, the antenna device 100 further includes a second mm-wave RFIC 60; the second mm-wave RFIC 60 is arranged on the flexible printed circuit board 21 and is located between the antenna structure 20 and the antenna stand 40; and the second mm-wave RFIC 60 is electrically connected to the second mm-wave antenna 22. The second mm-wave RFIC 60 is arranged on the flexible printed circuit board 21, so that the space utilization rate can be increased; and furthermore, the length of the path between the second mm-wave RFIC 60 and the second mm-wave antenna 22 can be reduced, thereby reducing the path loss and improving the communication performance of the second mm-wave antenna 22.

The antenna device 100 further includes a second conductive member 52; the antenna stand 40 has an opening 410; the second antenna structure 20 covers the opening 410; one end of the second conductive member 52 is arranged on the circuit board 30, and the other end of the second conductive member 52 passes through the opening 410 and is connected to the second mm-wave RFIC 60; the second mm-wave RFIC 60 includes a second mm-wave RFIC main body 61 electrically connected to the second mm-wave antenna 22 and a second shielding case 62 arranged at a periphery of the second mm-wave RFIC main body 61; the second shielding case 62 is electrically connected to the second non-mm-wave antenna 23; the second mm-wave RFIC main body 61 is electrically connected to the second mm-wave antenna 22; the second shielding case 62 is further grounded via the second conductive member 52; and the second conductive member 52 includes a first metal block. By means of the opening 410 and the second conductive member 52, the second conductive member 52 can achieve the technical effects of electrical connection, heat dissipation, and the like. In addition, the second shielding case 62 can protect the second mm-wave RFIC main body 61 from signal crosstalk, so the reliability is improved, and a relatively good radiation effect is achieved. In this embodiment, the opening 410 may be located on the first supporting part 41 and/or the second supporting part 112. In this embodiment, the second shielding case 62 directly contacts the second non-mm-wave antenna 23 on one side close to the antenna stand 40, so as to be electrically connected to the second non-mm-wave antenna 23. A pin 611 of the second mm-wave RFIC main body 61 may penetrate through the second shielding case 62 and is electrically connected to the second mm-wave antenna 22 via a fourth via hole 217 penetrating through the flexible printed circuit board 21.

The second antenna structure 20 further includes a second connector 63; and the second connector 63 is arranged on the flexible printed circuit board 21 and may be electrically connected to the second mm-wave RFIC main body 61 via an internal line of the flexible printed circuit board 21. It may also be convenient for the second connector 63 to electrically connect the second mm-wave antenna 22 and the second mm-wave RFIC main body 61 to the circuit board 30, thus achieving the technical effects of convenient assembling, reliable signal transmission, improved placement degree-of-freedom of the mm-wave antenna, and the like. The second connector 63 may be spaced apart from the second mm-wave RFIC 60, and the second connector 63 may be located on the outer side of the antenna stand 40, so as to facilitate connection with another external connector. Therefore, in this embodiment, one side of the first supporting part 41 of the antenna stand 40 may protrude from the second supporting part 42 and/or the third supporting part 43, and the second antenna structure 20 and the second connector 63 may be located on the outer side of the third supporting part 43, so as to facilitate connection with another external connector. Specifically, a pin of the second connector 63 may be electrically connected to the second mm-wave RFIC main body 61 and/or the second mm-wave antenna 22 via a fifth via hole 292 penetrating through one of the insulating layers 29, the first conductive line 28, and the like.

The antenna stand 40 has a first gap part 401; and at least part of the second connector 63 is exposed through the first gap part 401 and is used to be connected to another connector. In this embodiment, one side of the second supporting part 42 of the antenna stand 40 may protrude from the first supporting part 41 and the third supporting part 43 so that a side of the second supporting part 42 close to the third supporting part 43 and a side of the first supporting part 41 close to the third supporting part 43 are encircled to form the first gap part 401; and at least part of the second connector 63 is arranged at the first gap part 401, so as to facilitate connection with another external connector. It can be understood that the design of the first gap part 401 is conductive to connection of the second connector 63 to another connector, thus achieving the technical effects of convenient assembling and reliable signal transmission, and the like.

In addition, the second non-mm-wave antenna 23 located on two sides of the flexible printed circuit board 21 may be electrically connected with each other through the second via hole 216; the second non-mm-wave antenna 23 located on the side close to the antenna stand 40 further has a plurality of third avoiding regions 232; the fourth via hole 217 and the fifth via hole 292 correspond to the third avoiding regions 232, so as to avoid short-circuit connection between the second mm-wave RFIC main body 61 and the second connector 63.

In addition, in some embodiments, the second conductive member 52 may be grounded and achieve an isolation effect; when the second shielding case 62 and two ends of the second non-mm-wave antenna 23 can be electrically connected to one non-mm-wave antenna feed source assembly, respectively, a radiation effect of two non-mm-wave antennas can be achieved, and even a MIMO effect can be achieved, without increasing the size of the antenna device 100. Therefore, the user experience of the antenna device 100 is relatively high, and the overall competitiveness of the product is relatively high.

Embodiment IV

Figure 18:
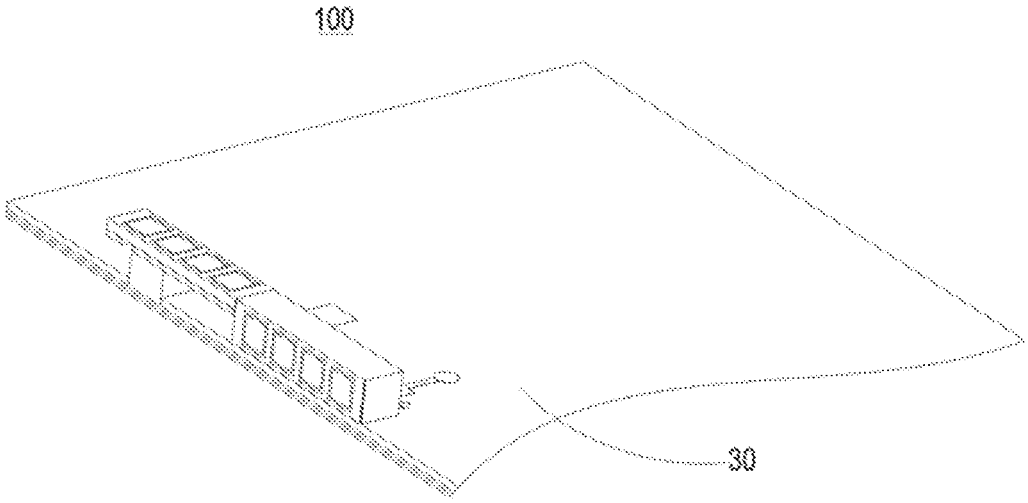
FIG. 18 is a three-dimensional diagram of an antenna device disclosed in Embodiment IV of the present disclosure.
Figure 19:
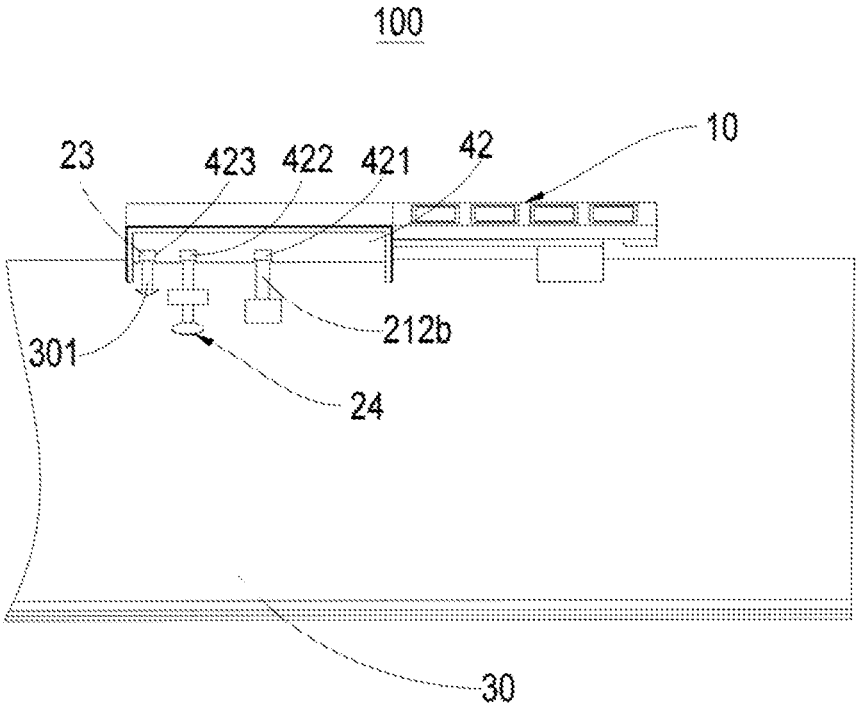
FIG. 19 is a three-dimensional diagram from another view of the antenna device shown in FIG. 18.

Referring to FIG. 18 and FIG. 19, parts, which are the same as those of the antenna device 100 in Embodiment I, of the antenna device 100 in this embodiment are not repeatedly described, and descriptions of differences between the antenna device 100 in this embodiment and the antenna device 100 in Embodiment I will be emphasized.

In Embodiment IV, the second supporting part 42 further has a third opening part 423, and the second non-mm-wave antenna 23 is electrically connected to the ground line 301 on the circuit board 30 via the third opening part 423. The second opening part 422 may be located on a side of the first opening part 421 away from the first antenna structure 10, and the third opening part 423 may be located on one side of the second opening part 422 away from the first opening part 421; and the non-mm-wave antenna feed source assembly 24 may be located between the ground line 301 and the second sub-part 212*b* superposed with the circuit board 30. It can be understood that the position design of the second opening part 422, the third opening part 423, and other elements of Embodiment IV is beneficial to the flexible structural design of the antenna device 100, such as increasing the flexibility of the design of the non-mm-wave antenna, thus improving the overall competitiveness of the product.

Embodiment V

Figure 20:
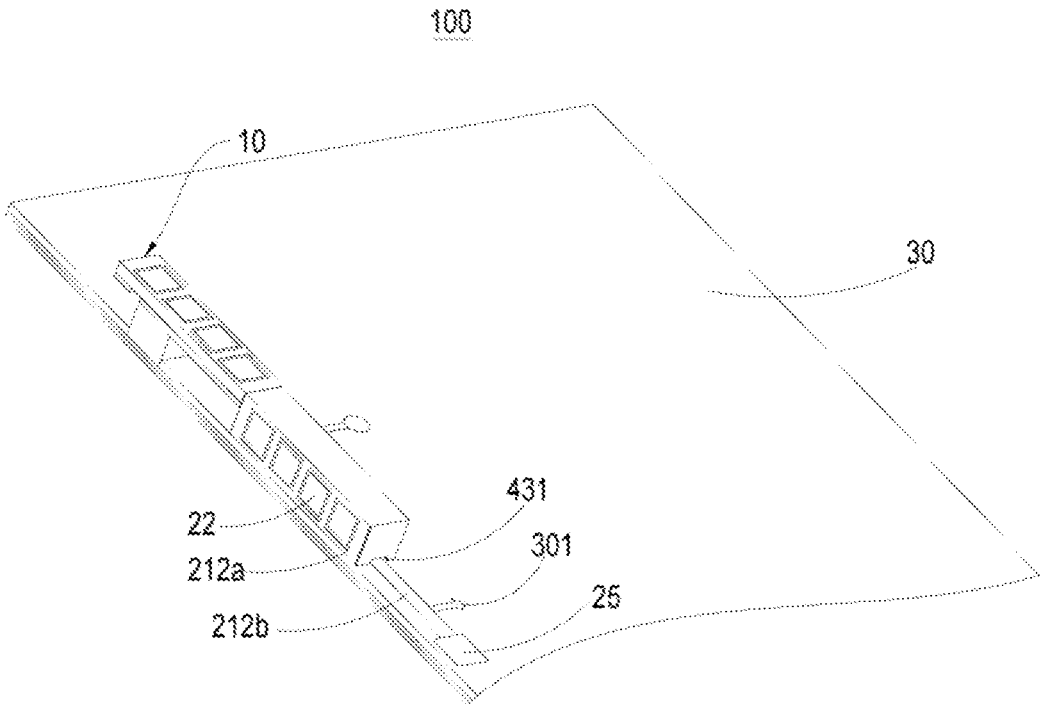
FIG. 20 is a three-dimensional diagram of an antenna device disclosed in Embodiment V of the present disclosure.
Figure 21:
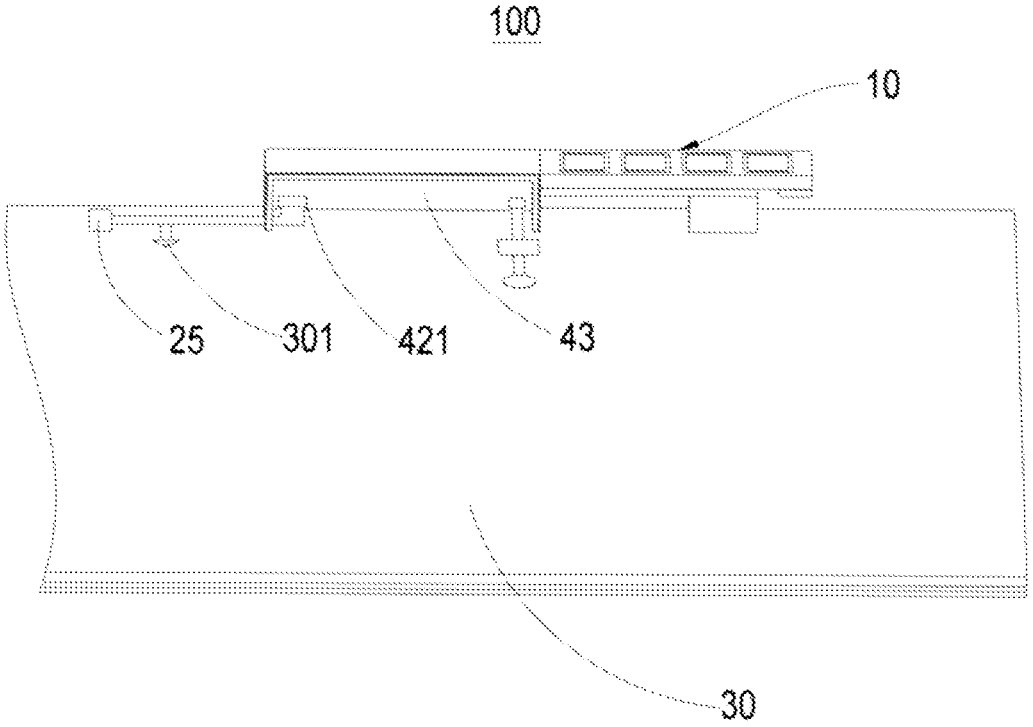
FIG. 21 is a three-dimensional diagram from another view of the antenna device shown in FIG. 20.

Referring to FIG. 20 and FIG. 21, parts, which are the same as those of the antenna device 100 in Embodiment I, of the antenna device 100 in this embodiment are not repeatedly described, and descriptions of differences between the antenna device 100 in this embodiment and the antenna device 100 in Embodiment I will be emphasized.

In Embodiment V, one third supporting part 43 away from the first antenna structure 10 further has a fourth opening part 431, and the second sub-part 212*b* sequentially passes through the first opening part 421 and the fourth opening part 431 and extends towards one side away from the first antenna structure 10. The second sub-part 212*b* is further electrically connected to the ground line 301 located on the circuit board 30; an end of the second sub-part 212*b* away from the first sub-part 212*a* is further used to be electrically connected to the second mm-wave RFIC 25, so that the second mm-wave antenna 22 is electrically connected to the second mm-wave RFIC 25 via the first conductive line (as shown in FIG. 6, FIG. 8, and FIG. 9.) The position design of the fourth opening part 431 and the second sub-part 212*b* of Embodiment IV is beneficial to the flexible structural design of the antenna device 100, such as the flexibility of the routing on the circuit board 30 and the placement of device elements, thus improving the overall competitiveness of the product.

Embodiment VI

Figure 22:
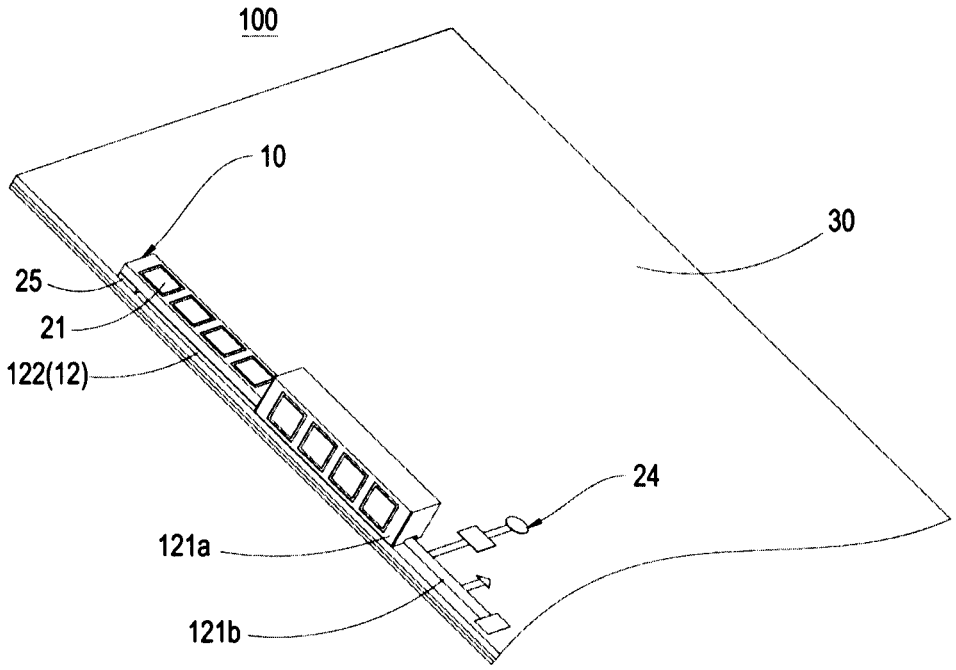
FIG. 22 is a three-dimensional diagram of an antenna device disclosed in Embodiment VI of the present disclosure.
Figure 23:
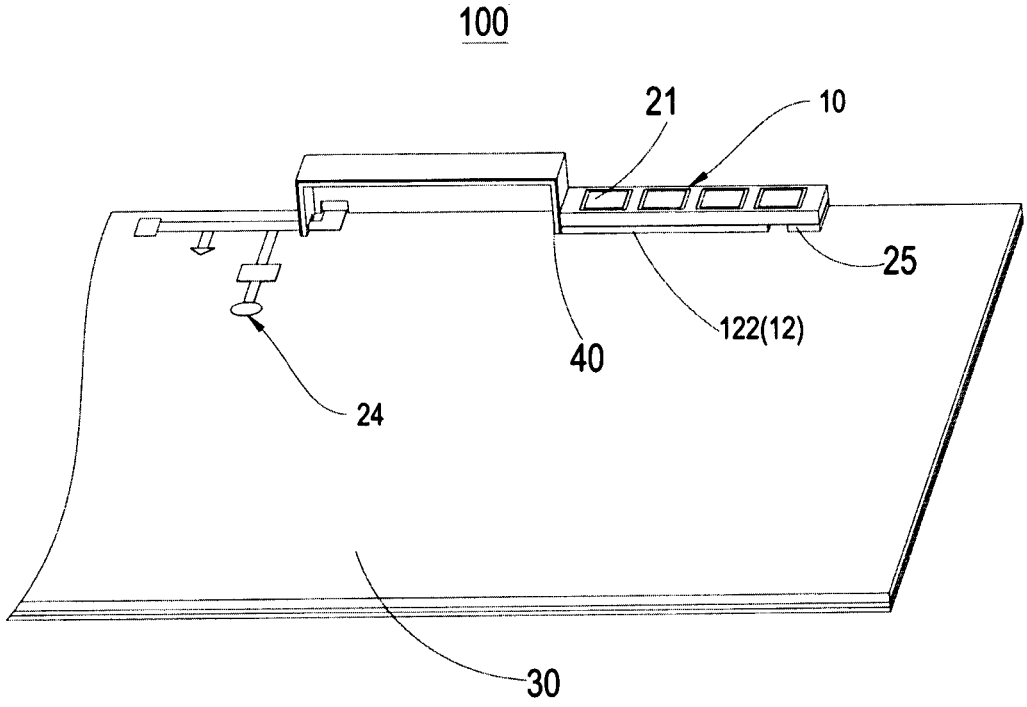
FIG. 23 is a three-dimensional diagram from another view of the antenna device shown in FIG. 21.

Referring to FIG. 22 and FIG. 23, parts, which are the same as those of the antenna device 100 in Embodiment V, of the antenna device 100 in this embodiment are not repeatedly described, and descriptions of differences between the antenna device 100 in this embodiment and the antenna device 100 in Embodiment V will be emphasized.

In Embodiment VI, the first conductive member located between the first antenna structure 10 and the circuit board 30 in Embodiment V can be omitted. Therefore, the first antenna structure 10 is arranged on the circuit board 30; the first shielding case 122, i.e., the first mm-wave RFIC 12, is located between the first mm-wave antenna 21 and the circuit board 30; the first shielding case 122 is further electrically connected to the ground line on the circuit board 30 or connected to the non-mm-wave antenna feed source assembly on the circuit board 30, so as to grounded or connected to a feed source through the circuit board 30; and the first connector 25 may directly contact and be electrically connected to the circuit board 30 (such as another connector on the circuit board 30). In addition, in Embodiment VI compared to Embodiment V, the second opening part 422 can be omitted; the end of the second sub-part 212*b* away from the first sub-part 212*a* is further used to be electrically connected to the non-mm-wave antenna feed source assembly 24. In particular, the non-mm-wave antenna feed source assembly 24 may be located on a side of the antenna stand 40 away from the first antenna structure 10. In some other embodiments, when the first shielding case 122 is connected to the ground line of the circuit board 30, each of two ends of the first shielding case 122 may be connected with one non-mm-wave antenna feed source assembly. At this time, the first shielding case 122 may achieve a radiation effect of two non-mm-wave antennas, without increasing the size of the antenna device 100, so that the user experience of the antenna device 100 is higher.

It can be understood that in Embodiment VI, the first conductive member and the second opening part are omitted, which is conductive to reducing the element cost and the assembling cost and improving the assembling efficiency and is also beneficial for the flexible structural design of the antenna device 100, such as the flexibility of the routing on the circuit board 30 and the placement of device elements, thus improving the overall competitiveness of the product.

Embodiment VII

Figure 24:
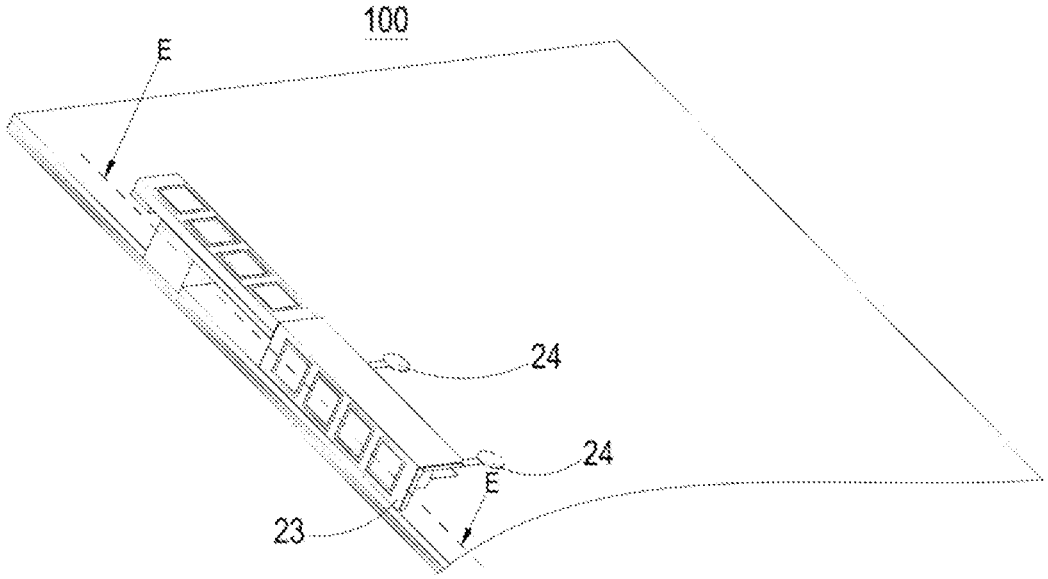
FIG. 24 is a three-dimensional diagram of an antenna device disclosed in Embodiment VII of the present disclosure.
Figure 25:
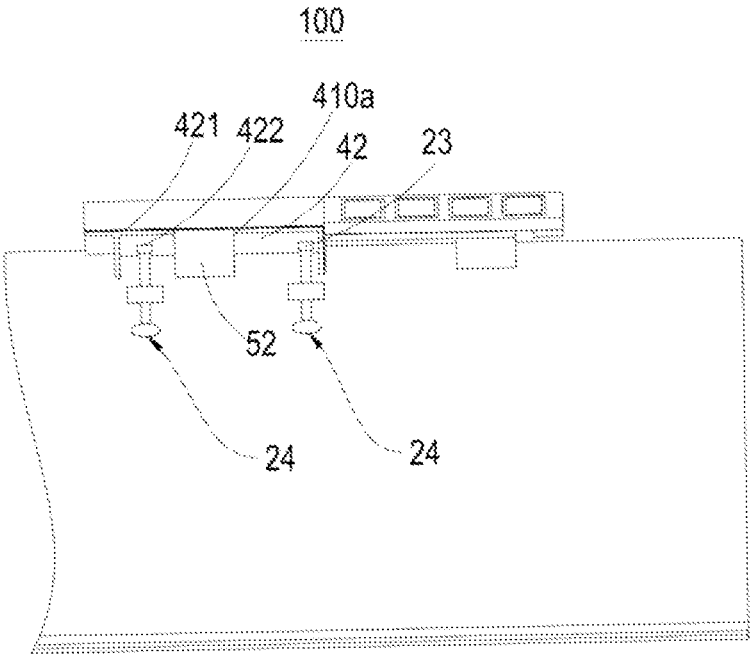
FIG. 25 is a three-dimensional diagram from another view of the antenna device shown in FIG. 24.
Figure 26:
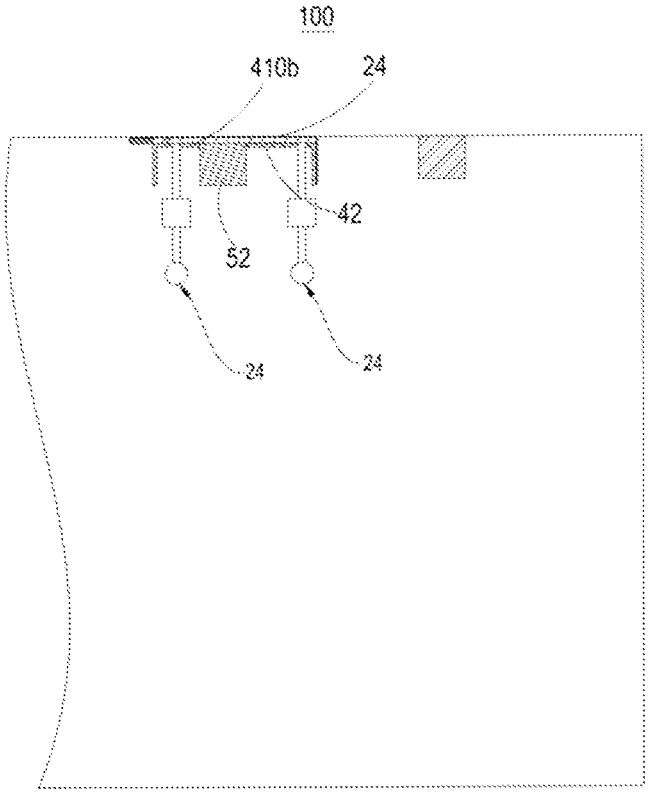
FIG. 26 is a partially sectional diagram of the antenna device of FIG. 24.

Referring to FIG. 24, FIG. 25, and FIG. 26, parts, which are the same as those of the antenna device 100 in Embodiment III, of the antenna device 100 in this embodiment are not repeatedly described, and descriptions of differences between the antenna device 100 in this embodiment and the antenna device 100 in Embodiment III will be emphasized.

In Embodiment VII, the second supporting part 42 is provided with two second opening parts 422, and the first supporting part 41 is provided with a first opening 410*a*; the second supporting part 42 is further provided with a second opening 410*b*; the second conductive member 52 is located between the two second opening parts 422; and the second conductive member 52 is electrically connected with the second shielding case 62 via the first opening 410*a* and the second opening 410*b*, so as to be electrically connected to the second non-mm-wave antenna 23. The circuit board 30 is provided with two non-mm-wave antenna feed source assemblies 24 corresponding to the two second opening parts 422 respectively, and each non-mm-wave antenna feed source assembly 24 is electrically connected with the second non-mm-wave antenna 23 via the corresponding second opening part 422.

It can be understood that in Embodiment VII, the second conductive member 52 may be grounded and achieve an isolation and heat dissipation effect, so that each of two ends of the second non-mm-wave antenna 23 can be electrically connected to one non-mm-wave antenna feed source assembly 24, thereby achieving a radiation effect of two non-mm-wave antennas and even achieving a MIMO effect, without increasing the size of the antenna device. Therefore, the user experience of the antenna device 100 is relatively high, and the overall competitiveness of the product is relatively high.

Embodiment VIII

Figure 27:
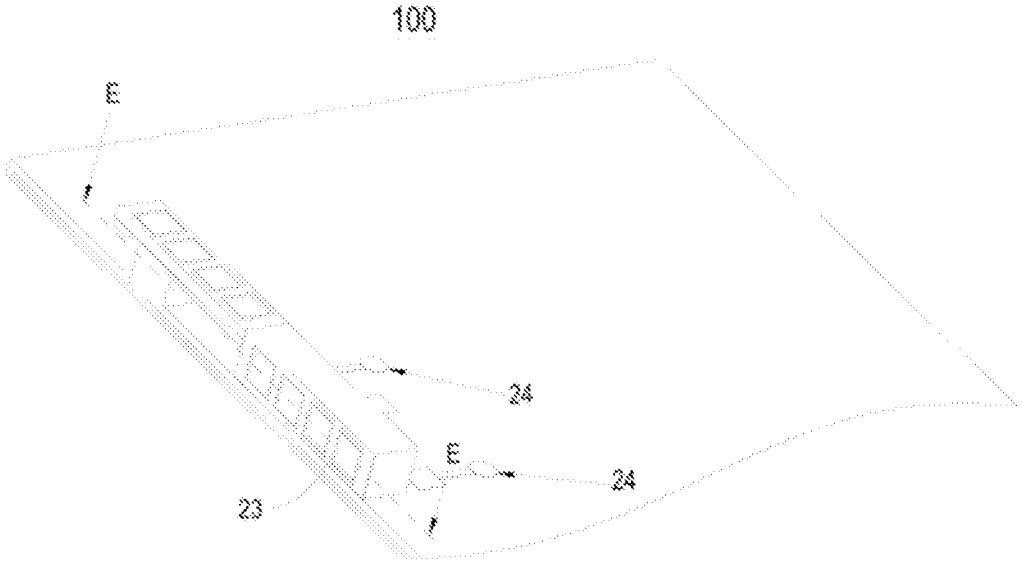
FIG. 27 is a three-dimensional diagram of an antenna device disclosed in Embodiment VIII of the present disclosure.
Figure 28:
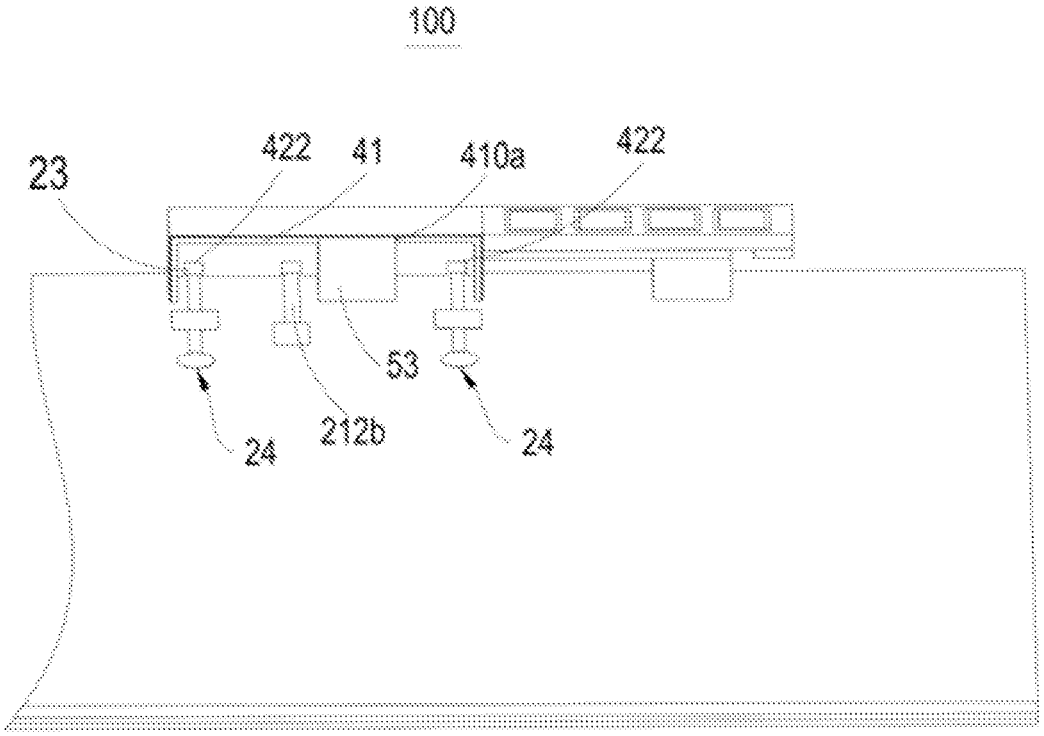
FIG. 28 is a three-dimensional diagram from another view of the antenna device shown in FIG. 27.
Figure 29:
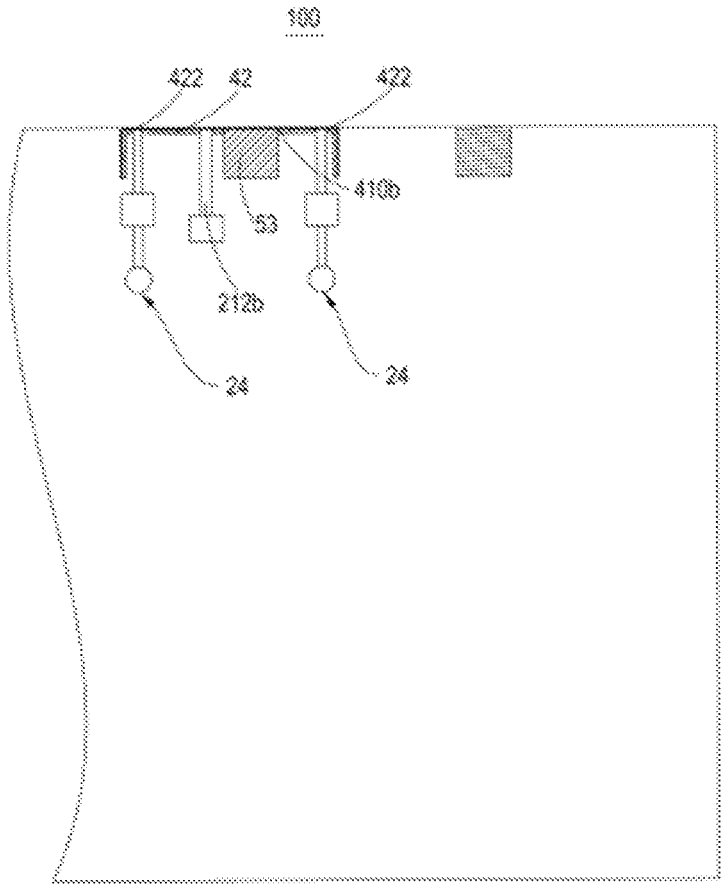
FIG. 29 is a sectional diagram of the antenna device shown in FIG. 27 along line E-E.

Referring to FIG. 27, FIG. 28, and FIG. 29, parts, which are the same as those of the antenna device 100 in Embodiment I, of the antenna device 100 in this embodiment are not repeatedly described, and descriptions of differences between the antenna device 100 in this embodiment and the antenna device 100 in Embodiment I will be emphasized.

In Embodiment VIII, the antenna device 100 further includes a third conductive member 53; the first supporting part 41 has a first opening 410*a*; the second supporting part 42 has a second opening 410*b*; and the third conductive member 53 passes through the first opening 410*a* and the second opening 410*b* and is electrically connected between the second non-mm-wave antenna 23 and the circuit board 30. Specifically, the third conductive member 53 may be a third metal block used to achieve the technical effects of isolation, supporting, electrical connection (such as grounding), and the like. Specifically, the third conductive member 53 includes the third metal block, which not only plays a supporting role, but also discharges heat to the outside while it is grounded, so as to reduce the temperature of the antenna device 100 (the mm-wave RFIC main body 61) and maintain the stability of a wireless communication function, thus improving the product performance and the grip comfort of the user. The third conductive member 52 is grounded and achieves an isolation effect, so that each of two ends of one second non-mm-wave antenna can be electrically connected to one non-mm-wave antenna feed source assembly, thus achieving a radiation effect of two non-mm-wave antennas, and even achieving a MIMO effect, without increasing the size of the antenna device 100. Therefore, the user experience of the antenna device 100 is relatively high, and the overall competitiveness of the product is relatively high.

The second supporting part 42 is provided with two second opening parts 422; the third conductive member 53 is located between the two opening parts 422; the circuit board 30 is provided with two non-mm-wave antenna feed source assemblies 24 respectively corresponding to the two second opening parts 422; and each non-mm-wave antenna feed source assembly 24 is electrically connected to the second non-mm-wave antenna 23 via the corresponding second opening part 422. The second sub-part 212*b* is also located between the two second opening parts 422, but is staggered from the third conductive member 53.

It can be understood that in Embodiment VIII, by means of the third conductive member 53 and the two non-mm-wave antenna feed source assemblies 24, each of two ends of the second non-mm-wave antenna 23 can be electrically connected to one non-mm-wave antenna feed source assembly 24, thereby achieving a radiation effect of two non-mm-wave antennas, without increasing the size of the antenna device 100, so that the user experience of the antenna device 100 is relatively high.

Embodiment IX

Figure 30:
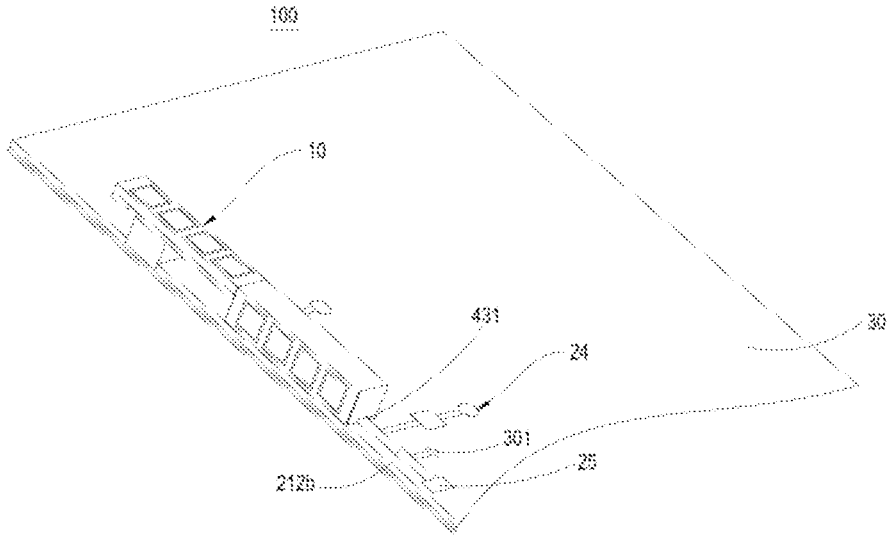
FIG. 30 is a three-dimensional diagram of an antenna device disclosed in Embodiment IX of the present disclosure.
Figure 31:
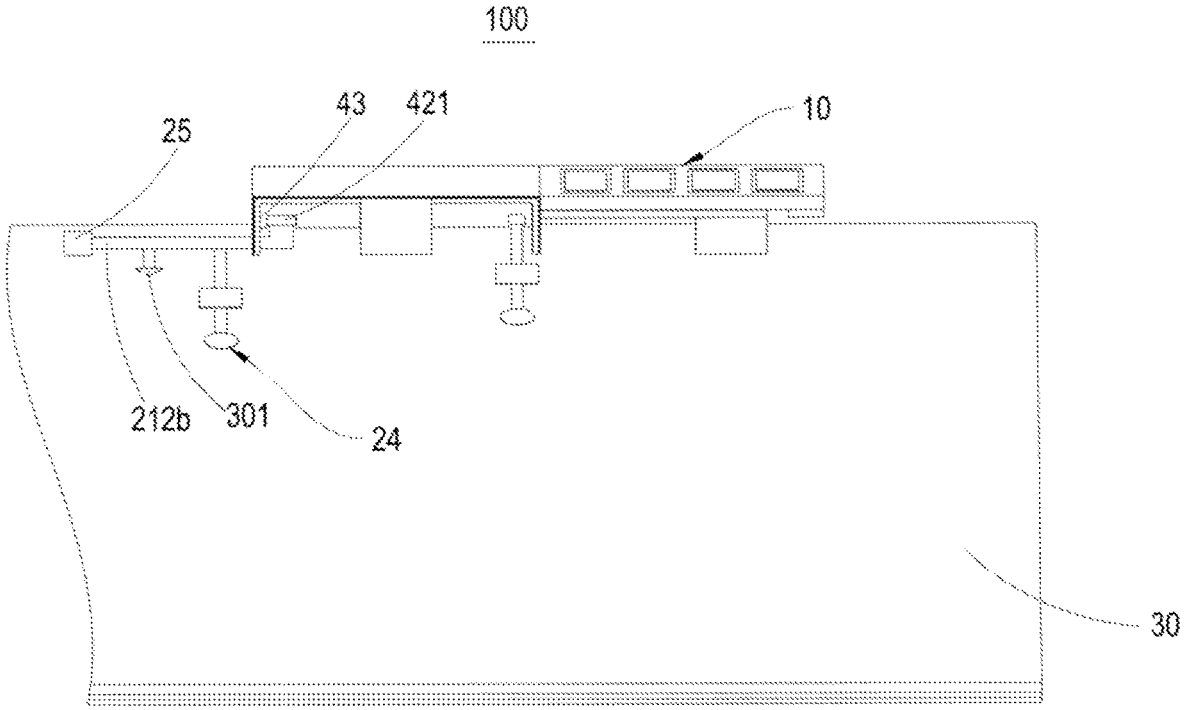
FIG. 31 is a three-dimensional diagram from another view of the antenna device shown in FIG. 30.
Figure 32:
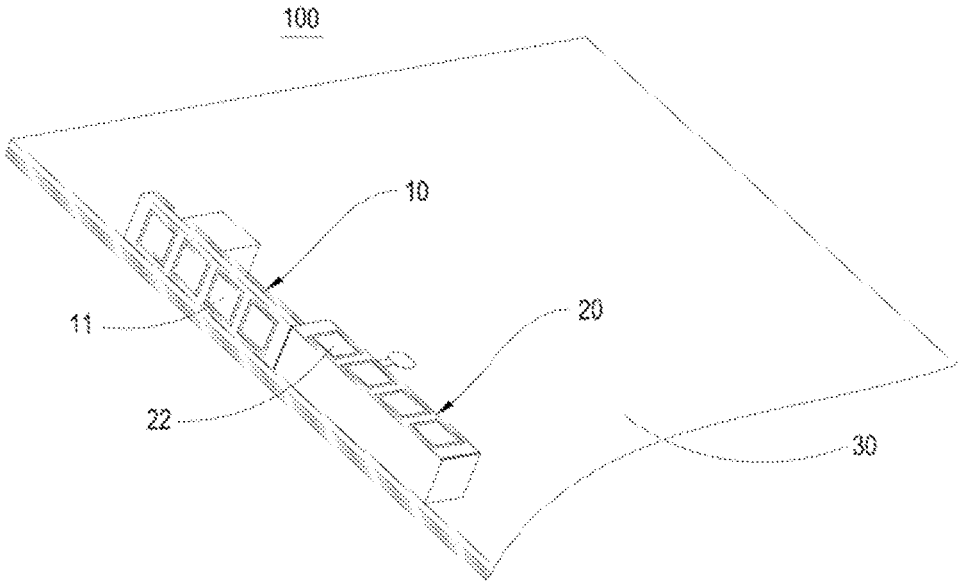
FIG. 32 is a three-dimensional diagram of an antenna device disclosed in Embodiment X of the present disclosure.
Figure 33:
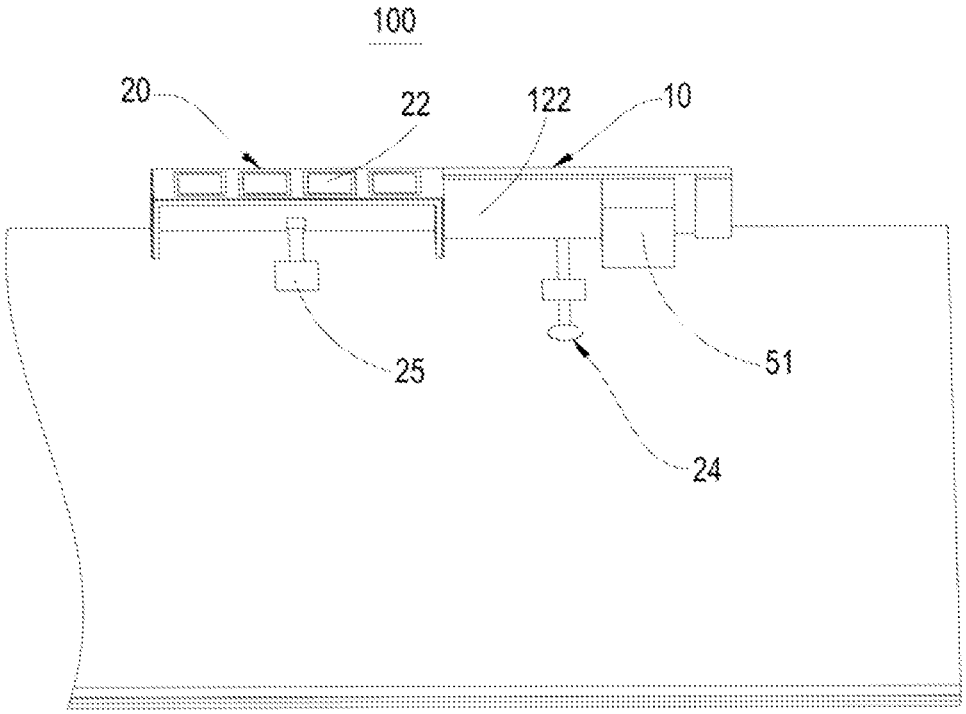
FIG. 33 is a three-dimensional diagram from another view of the antenna device shown in FIG. 32.
Figure 34:
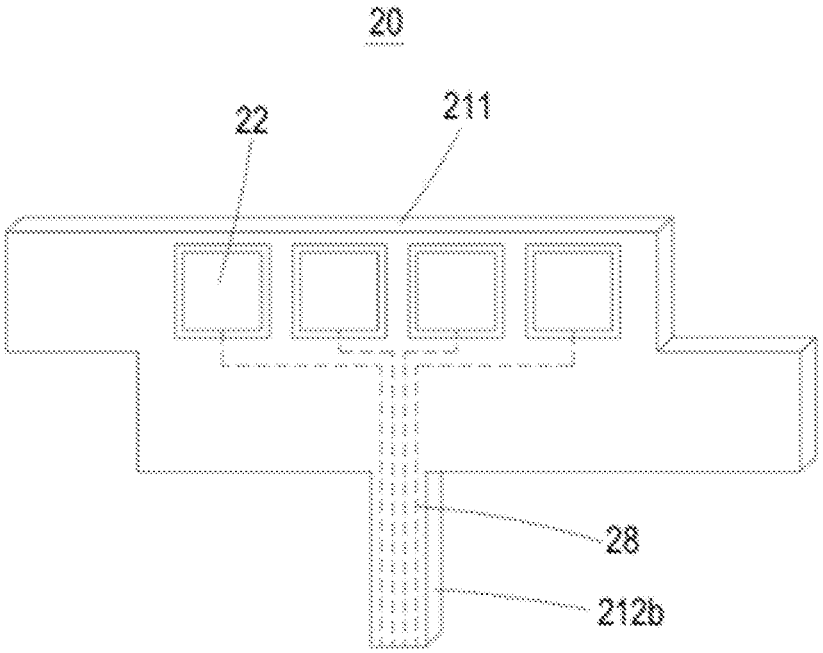
FIG. 34 is a three-dimensional diagram illustrating that a second antenna structure of the antenna device shown in FIG. 32 is in a spread state.
Figure 35:
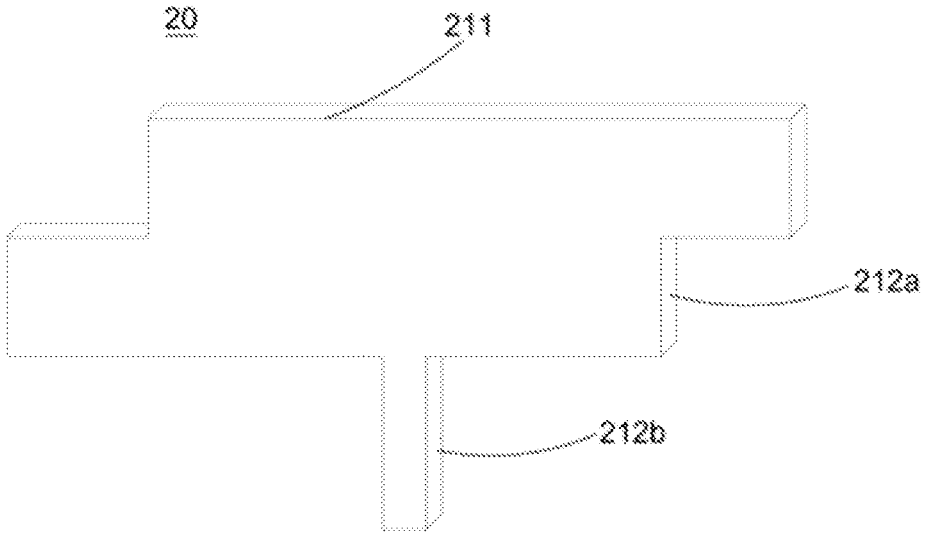
FIG. 35 is a three-dimensional diagram from another view of the antenna structure shown in FIG. 34.

Referring to FIG. 30 and FIG. 31, parts, which are the same as those of the antenna device 100 in Embodiment VIII, of the antenna device 100 in this embodiment are not repeatedly described, and descriptions of differences between the antenna device 100 in this embodiment and the antenna device 100 in Embodiment VIII will be emphasized.

In Embodiment IX, one third supporting part 43 away from the first antenna structure 10 further has a fourth opening part 431, and the second sub-part 212*b* sequentially passes through the first opening part 421 and the fourth opening part 431 and extends towards one side away from the first antenna structure 10. The second sub-part 212*b* is further electrically connected to the ground line 301 located on the circuit board 30; an end of the second sub-part 212*b* away from the first sub-part 212*a* is further used to be electrically connected to the second mm-wave RFIC 25, so that the second mm-wave antenna 22 is electrically connected to the second mm-wave RFIC 25 via the first conductive line (as shown in FIG. 6, FIG. 8, and FIG. 9.) The second sub-part 212*b* is further electrically connected to the non-mm-wave feed source assemblies 24 on the circuit board 30, so that the second non-mm-wave antenna 23 is electrically connected to the non-mm-wave feed source assemblies 24.

The position design of the fourth opening part 431 and the second sub-part 212*b* of Embodiment IX is beneficial to the flexible structural design of the antenna device 100, such as the flexibility of the routing on the circuit board 30 and the placement of device elements, thus improving the overall competitiveness of the product.

Embodiment X

Referring to FIG. 32 to FIG. 35, parts, which are the same as those of the antenna device 100 in Embodiment I, of the antenna device 100 in this embodiment are not repeatedly described, and descriptions of differences between the antenna device 100 in this embodiment and the antenna device 100 in Embodiment I will be emphasized.

In Embodiment X, the second mm-wave antenna 22 is arranged on the first part 211, and the first conductive line 28 extends from the first part 211 to the second sub-part 212*b* via the first sub-part 212*a* in sequence, so as to be electrically connected to the second mm-wave antenna RFIC 25 on the circuit board 30. In addition, the first antenna structure 10 is arranged on the circuit board 30 and is located on the outer side of the first conductive member 51. In addition, the first mm-wave antenna 11 may be located on a first plane, and the second mm-wave antenna 22 may be located on a second plane that is different from the first plane. The first plane and the second plane may be perpendicular to each other, but are not limited to being perpendicular to each other, and they may also be in a preset angle. Specifically, the first plane may be perpendicular to the board surface 302 of the circuit board 30, and the second plane may be parallel to the board surface 302 of the circuit board 30. It can be seen that the position design of the first antenna structure 10 and the second mm-wave antenna 22 on the second antenna structure 20 is beneficial to the flexible structural design of the antenna device 100, such as the flexibility of the routing on the circuit board 30 and the placement of device elements, thus improving the overall competitiveness of the product.

Figure 36:
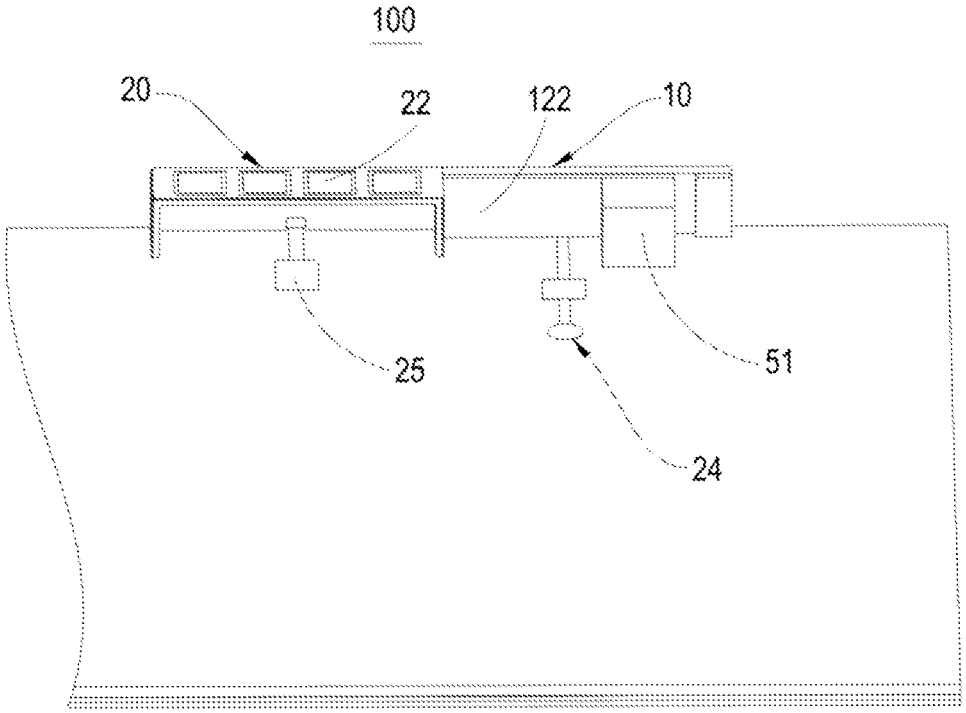
FIG. 36 is a three-dimensional diagram of an antenna device disclosed in a change embodiment of Embodiment X of the present disclosure.

Further, in this embodiment, the non-mm-wave antenna feed source assembly 24 is electrically connected to the second non-mm-wave antenna 23 through the second opening part 422. However, as shown in FIG. 36, the second opening part 422 may be omitted, and the non-mm-wave antenna feed source assembly 24 may be directly connected to the first shielding case 122 of the first antenna structure 10, so as to be electrically connected to the first non-mm-wave antenna 13. In addition, the first shielding case 122 further contacts and is electrically connected to the second non-mm-wave antenna 23, so that the first non-mm-wave antenna 13, the first shielding case 122, and the second non-mm-wave antenna 23 enable the entire non-mm-wave antenna to be connected with a feed source at the first shielding case 122.

Embodiment XI

Figure 37:
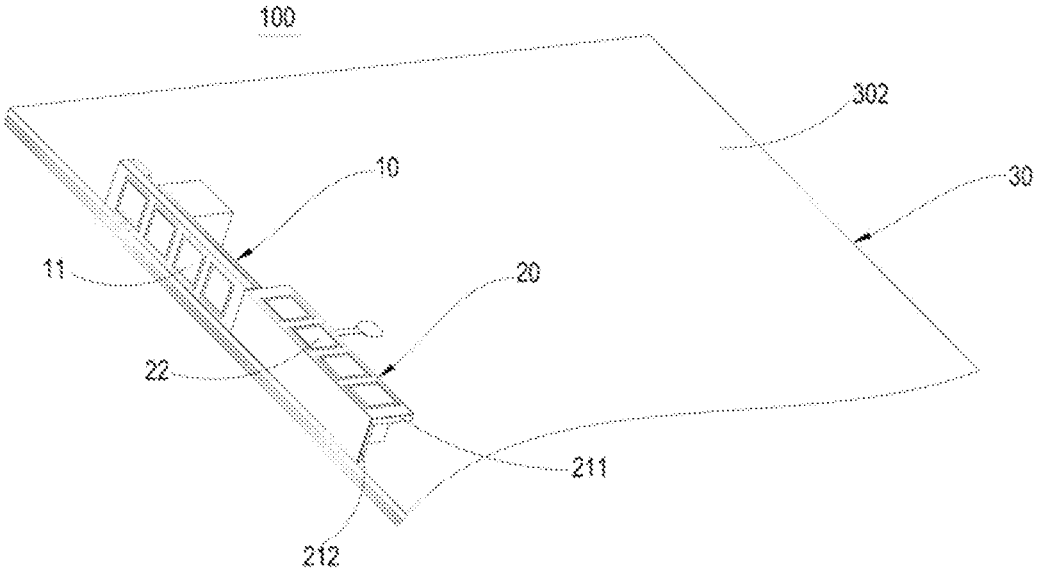
FIG. 37 is a three-dimensional diagram of an antenna device disclosed in Embodiment XI of the present disclosure.
Figure 38:
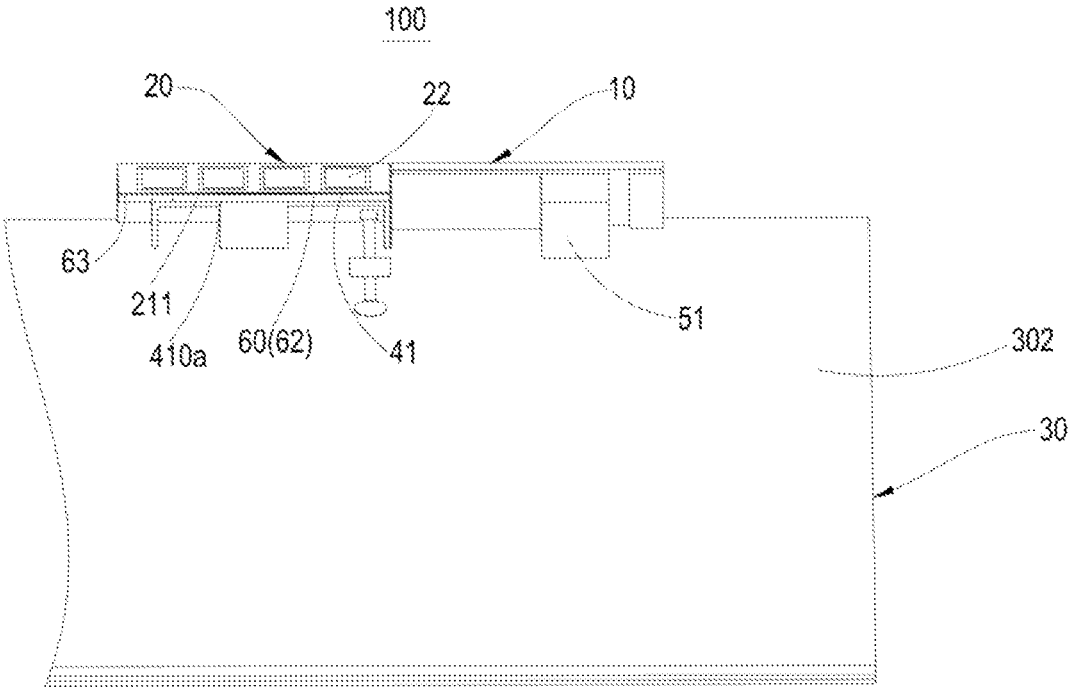
FIG. 38 is a three-dimensional diagram from another view of the antenna device shown in FIG. 37.

Referring to FIG. 37 to FIG. 38, parts, which are the same as those of the antenna device 100 in Embodiment III, of the antenna device 100 in this embodiment are not repeatedly described, and descriptions of differences between the antenna device 100 in this embodiment and the antenna device 100 in Embodiment III will be emphasized.

In Embodiment XI, the second mm-wave antenna 22 is arranged on the first part 211, and the second mm-wave RFIC 60 is located between the second antenna structure 20 and the first supporting part 41; the first supporting part 41 has an opening 410*a*; the second conductive member 52 is electrically connected with the second shielding case 62 of the second mm-wave RFIC 60 through the opening 410*a*; the second connector 63 is spaced apart from the second mm-wave RFIC 60 and is used to be electrically connected with another connector to electrically connect the second mm-wave RFIC 60 to the circuit board 30; and the first antenna structure 10 is arranged on the circuit board 30 and is located on the outer side of the first conductive member 51. In addition, the first mm-wave antenna 11 may be located on a first plane, and the second mm-wave antenna 22 may be located on a second plane. The first plane and the second plane may be perpendicular to each other. Specifically, the first plane may be perpendicular to the board surface 302 of the circuit board 30, and the second plane may be parallel to the board surface 302 of the circuit board 30. It can be seen that the position design of the first antenna structure 10 and the second mm-wave antenna 22 on the second antenna structure 20 is beneficial to the flexible structural design of the antenna device 100, such as the flexibility of the routing on the circuit board 30 and the placement of device elements, thus improving the overall competitiveness of the product.

Embodiment XII

Figure 39:
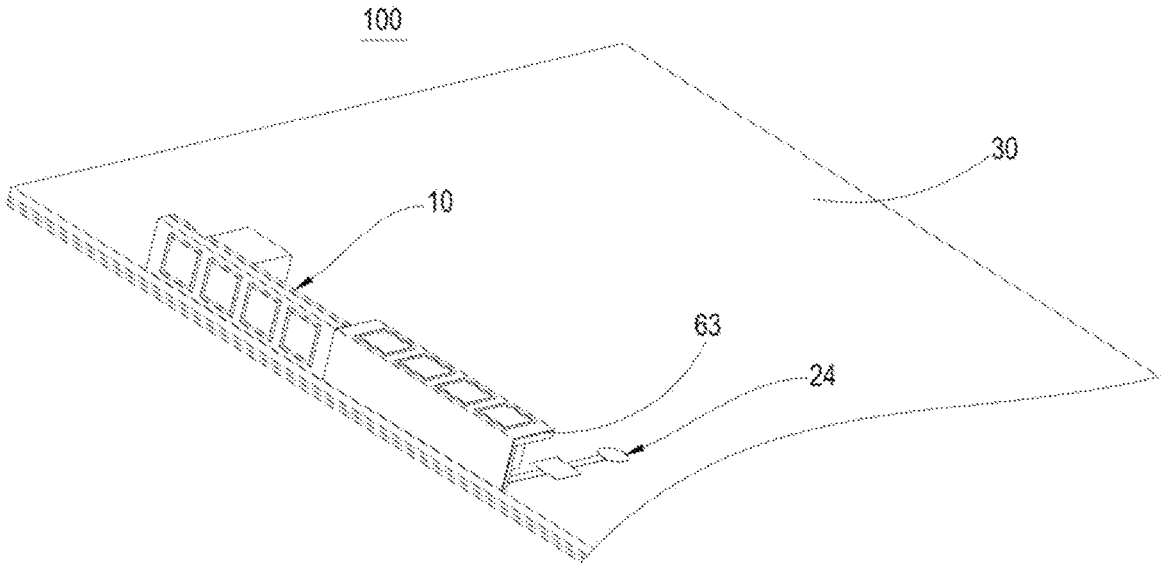
FIG. 39 is a three-dimensional diagram of an antenna device disclosed in Embodiment XII of the present disclosure.
Figure 40:
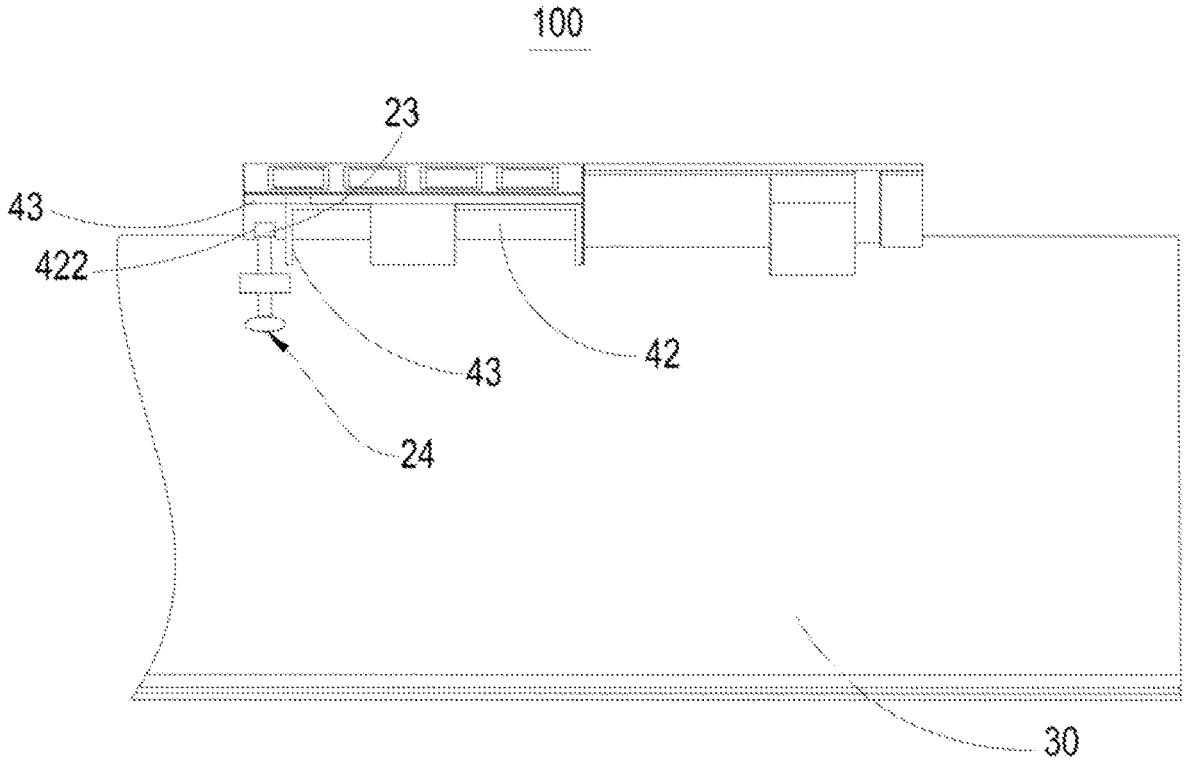
FIG. 40 is a three-dimensional diagram from another view of the antenna device shown in FIG. 39.

Referring to FIG. 39 to FIG. 40, parts, which are the same as those of the antenna device 100 in Embodiment XI, of the antenna device 100 in this embodiment are not repeatedly described, and descriptions of differences between the antenna device 100 in this embodiment and the antenna device 100 in Embodiment XI will be emphasized.

In Embodiment XII, the second opening part 422 is located at an end of the second supporting part 42 away from the first antenna structure 10, and the second opening part 422 is located on the outer side of the third supporting part 43 away from the first antenna structure 10; the second connector 63 is located above the second opening part 422; and the second non-mm-wave antenna 23 is electrically connected to the non-mm-wave antenna feed source assembly 24 on the circuit board 30 via the second opening part 422. It can be seen that the position design of the second opening part 422 and the non-mm-wave antenna feed source assembly 24 is beneficial to the flexible structural design of the antenna device 100, such as the flexibility of the routing on the circuit board 30 and the placement of device elements, thus improving the overall competitiveness of the product.

Embodiment XIII

Figure 41:
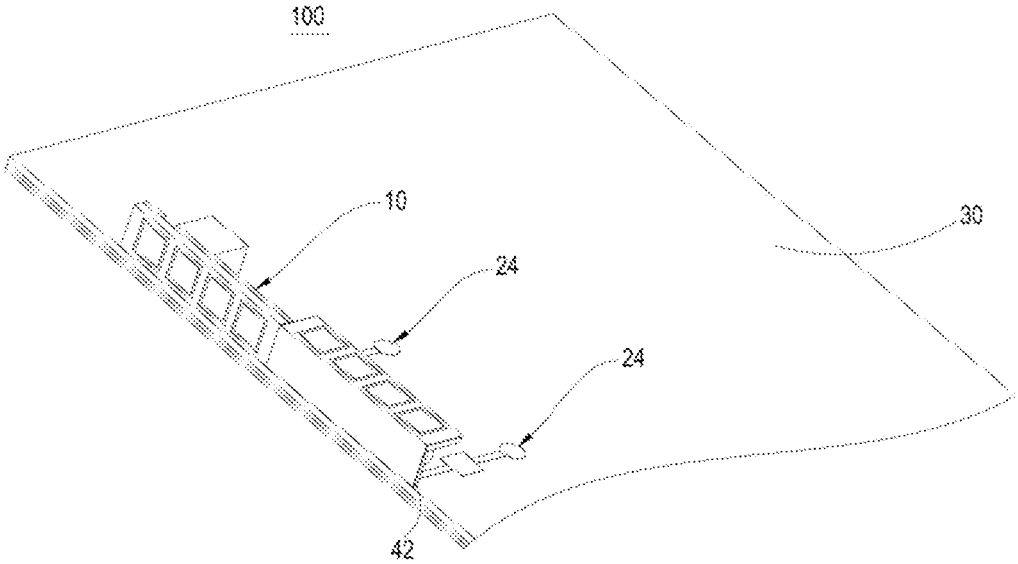
FIG. 41 is a three-dimensional diagram of an antenna device disclosed in Embodiment XIII of the present disclosure.
Figure 42:
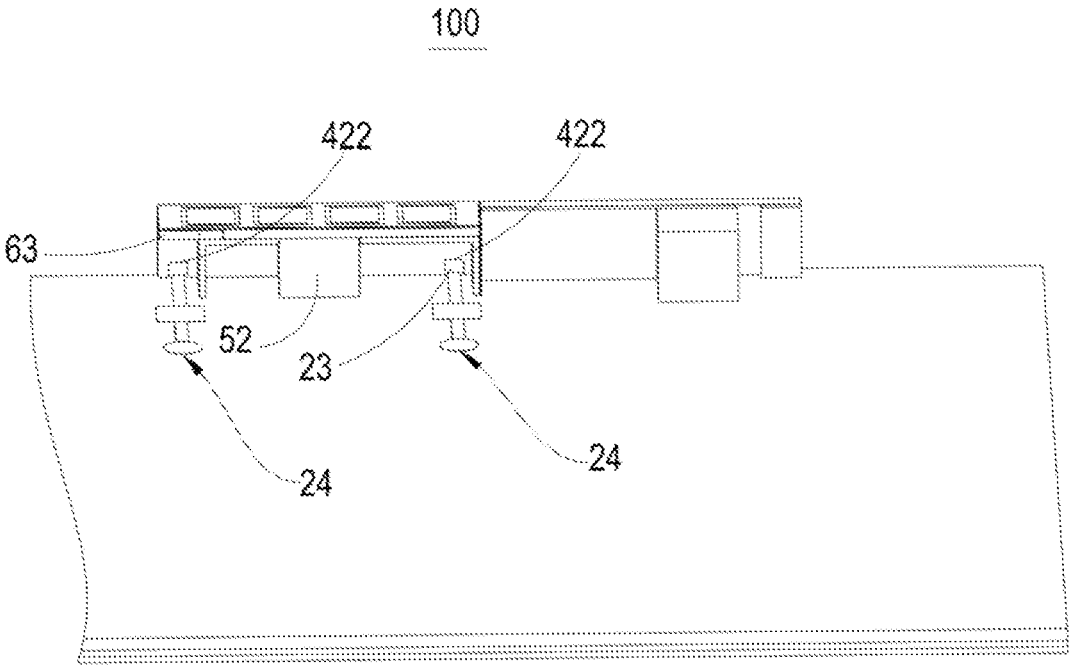
FIG. 42 is a three-dimensional diagram from another view of the antenna device shown in FIG. 41.
Figure 43:
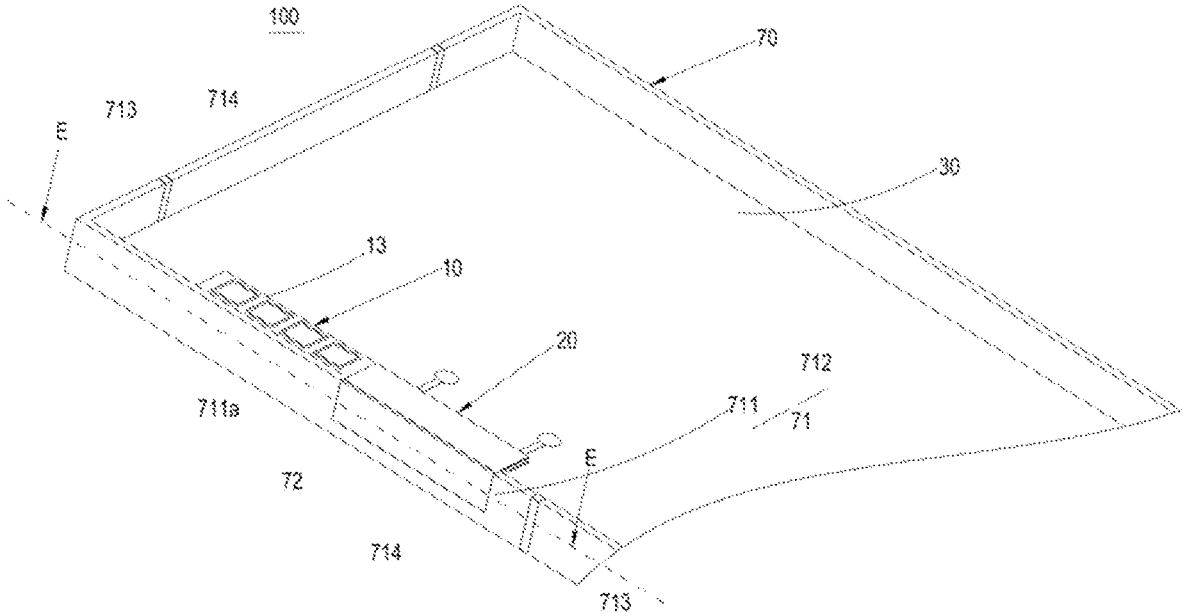
FIG. 43 is a three-dimensional diagram of an antenna device disclosed in Embodiment XIV of the present disclosure.
Figure 44:
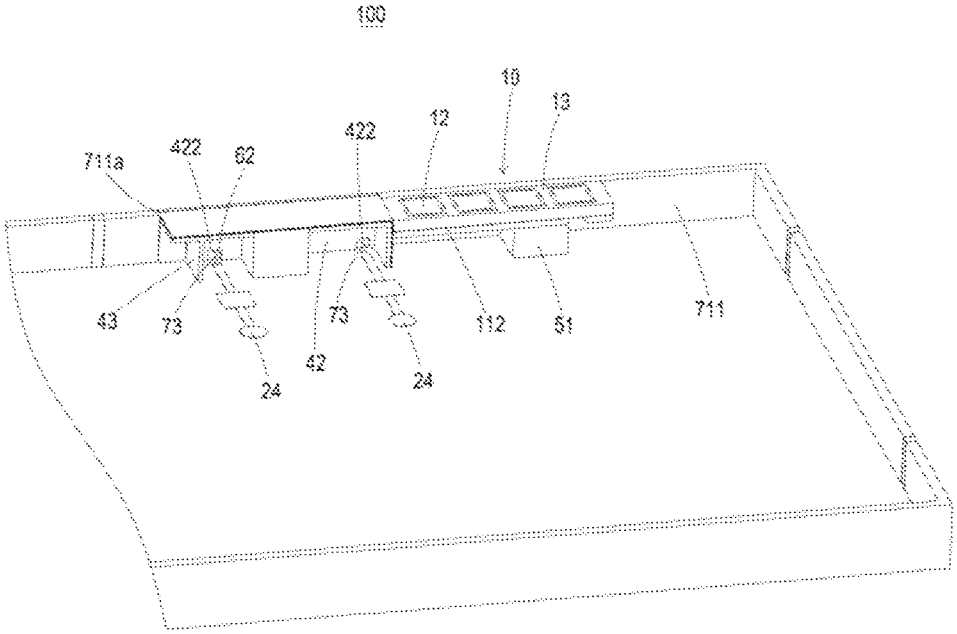
FIG. 44 is a three-dimensional diagram from another view of the antenna device shown in FIG. 43.
Figure 45:
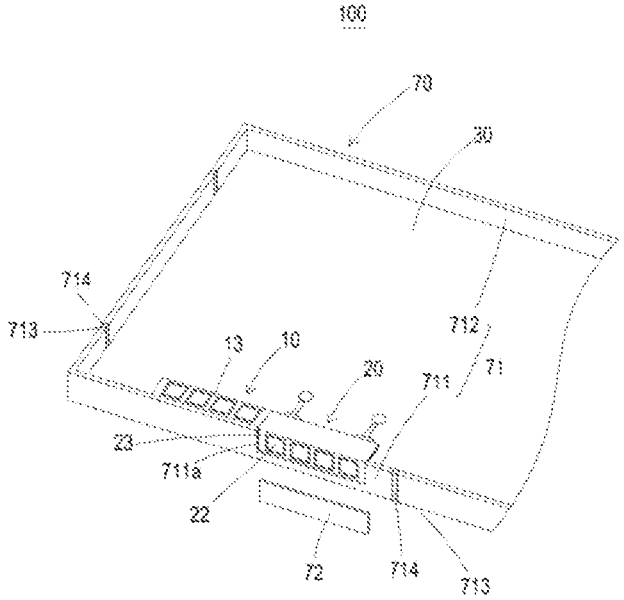
FIG. 45 is a partially exploded diagram of the antenna device shown in FIG. 43.

Referring to FIG. 41 to FIG. 42, parts, which are the same as those of the antenna device 100 in Embodiment XI, of the antenna device 100 in this embodiment are not repeatedly described, and descriptions of differences between the antenna device 100 in this embodiment and the antenna device 100 in Embodiment XI will be emphasized.

In Embodiment XIII, the number of the second opening parts 422 is two; one second opening part 422 is located at an end of the second supporting part 42 close to the first antenna structure 10, and the other second opening 422 is located at an end of the second supporting part 42 away from the first antenna structure 10 and is located on the outer side of the third supporting part 43 away from the first antenna structure 10; and the second connector 63 is located above the other second opening part 422. The number of the non-mm-wave antenna feed source assemblies 24 is two; the two non-mm-wave antenna feed source assemblies 24 are in one-to-one correspondence to the two second opening parts 422; and the second non-mm-wave antenna 23 is electrically connected to the corresponding non-mm-wave antenna feed source assemblies 24 via the second opening parts 422.

It can be understood that in Embodiment VIII, by means of the second conductive member 52 and the two non-mm-wave antenna feed source assemblies 24, each of two ends of the second non-mm-wave antenna 23 can be electrically connected to one non-mm-wave antenna feed source assembly 24, thereby achieving a radiation effect of two non-mm-wave antennas and even achieving a MIMO effect, without increasing the size of the antenna device 100, so that the user experience of the antenna device 100 is relatively high, and the overall competitiveness of the product is relatively high. In addition, the position design of the second opening part 422 and the non-mm-wave antenna feed source assembly 24 is beneficial to the flexible structural design of the antenna device 100, such as the flexibility of the routing on the circuit board 30 and the placement of device elements, thus improving the overall competitiveness of the product.

Embodiment XIV

Referring to FIG. 43 to FIG. 46, parts, which are the same as those of the antenna device 100 in Embodiment III, of the antenna device 100 in this embodiment are not repeatedly described, and descriptions of differences between the antenna device 100 in this embodiment and the antenna device 100 in Embodiment III will be emphasized.

In Embodiment XIV, the antenna device 100 further includes a housing 70 which is arranged at a periphery of the circuit board 30; and at least part of the housing 70 is electrically connected to the second non-mm-wave antenna 23. The housing 70 may be a border of the electronic apparatus using the antenna device 100, but is not limited to a border, or it may be a front cover or a rear cover. At least part of the housing 70 is a conductive material and is electrically connected to the second non-mm-wave antenna 23. The housing 70 includes a side wall structure 71 annularly arranged at a periphery of the circuit board 30; the side wall structure 71 includes a side wall main body 712 and an antenna part 711 connected with the side wall main body 712; a slit 713 may be reserved between the side wall main body 712 and the antenna part 711; and the slit 713 may be filled with an insulating medium. A material of the side wall structure 71 may be a conductor material, such as a metal conductor material; the antenna part 711 may contact the second non-mm-wave antenna 23, so as to be electrically connected to the second non-mm-wave antenna 23; the antenna part 711 may be further electrically connected to the first conductive member 51, so as to be electrically connected to the first shielding case 122 and the first non-mm-wave antenna 13. It can be understood that the antenna part 711 is electrically connected to the second non-mm-wave antenna 23 and the first non-mm-wave antenna 13, which can effectively increase and/or enlarge the length and/or area of the non-mm-wave antenna of the antenna device 100, so as to improve the performance of the non-mm-wave antenna and be conductive to reducing the overall size of the first antenna structure 10 and the second antenna structure 20 and improving the performance of the non-mm-wave antenna. The housing 70 is generally located on the outermost side of the electronic apparatus, which is also conductive to avoiding an antenna signal from being shielded or reducing signal shielding, thereby improving the antenna performance, the wireless communication experience of the user, and the overall competitiveness of the product.

Further, the antenna part 711 may have a gap 711*a*; at least part of the second antenna structure 20 is arranged in the gap 711*a*; and the gap 711*a* can avoid an antenna signal from being shielded or reducing signal shielding and improve the wireless communication experience. The antenna device 100 further includes a decorative member 72. The decorative member 72 may be arranged in the gap 711*a* and is located on the outer side of the second antenna structure 20, so as to shield the second antenna structure 20. Specifically, the decorative member 72 may cover the outer side of the second mm-wave antenna 22 of the second antenna structure 20, is used to protect the second mm-wave antenna 22, and basically does not affect the antenna performance of the second mm-wave antenna 22. In addition, an outer surface of the decorative member 72 may be flush with an outer surface of the antenna part 711, so as to achieve an attractive and reliable effect.

In addition, the second supporting part 42 may have two second opening parts 422; one second opening part 422 is located at an end of the second supporting part 42 close to the first antenna structure 10, and the other second opening 422 is located at an end of the second supporting part 42 away from the first antenna structure 10 and is located on the outer side of the third supporting part 43 away from the first antenna structure 10. The number of the non-mm-wave antenna feed source assemblies 24 is two; the two non-mm-wave antenna feed source assemblies 24 are in one-to-one correspondence to the two second opening parts 422; and the second non-mm-wave antenna 23 is electrically connected to the corresponding non-mm-wave antenna feed source assemblies 24 via the second opening parts 422. In this embodiment, the antenna device 100 further includes an electrical connection member 73; the electrical connection member 73 may be a clip, but is not limited to a clip, and the electrical connection member 73 passes through the second opening part 422, and the second part (i.e., the second non-mm-wave antenna 23 on it) is electrically connected to the non-mm-wave antenna feed source assembly 24 through the electrical connection member 73. The above-mentioned realization of the electrical connection through the electrical connection member can improve the flexibility of structural design of the antenna device.

Figure 46:
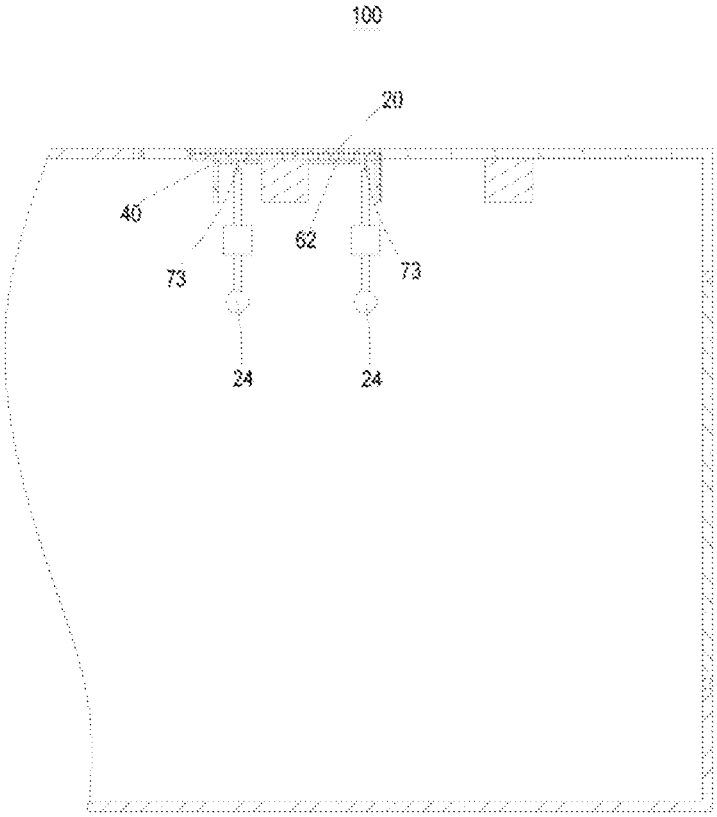
FIG. 46 is a sectional diagram of the antenna device shown in FIG. 43 along line E-E.

Specifically, as shown in FIG. 46, the second shielding case 62 is further provided between the second non-mm-wave antenna 23 of the second antenna structure 20 and the antenna stand 40; and the second shielding case 62 contacts and is electrically connected with the second non-mm-wave antenna 23 of the second antenna structure 20. Therefore, the second non-mm-wave antenna 23 on the second part 212 is electrically connected to the non-mm-wave antenna feed source assembly 24 through the second shielding case 62 and the electrical connection member 73. However, it can be understood that in a change embodiment, when the second shielding case 62 is omitted, the second part (i.e., the second non-mm-wave antenna 23 on it) may be electrically connected to the non-mm-wave antenna feed source assembly 24 through the electrical connection member 73.

Embodiment XV

Figure 47:
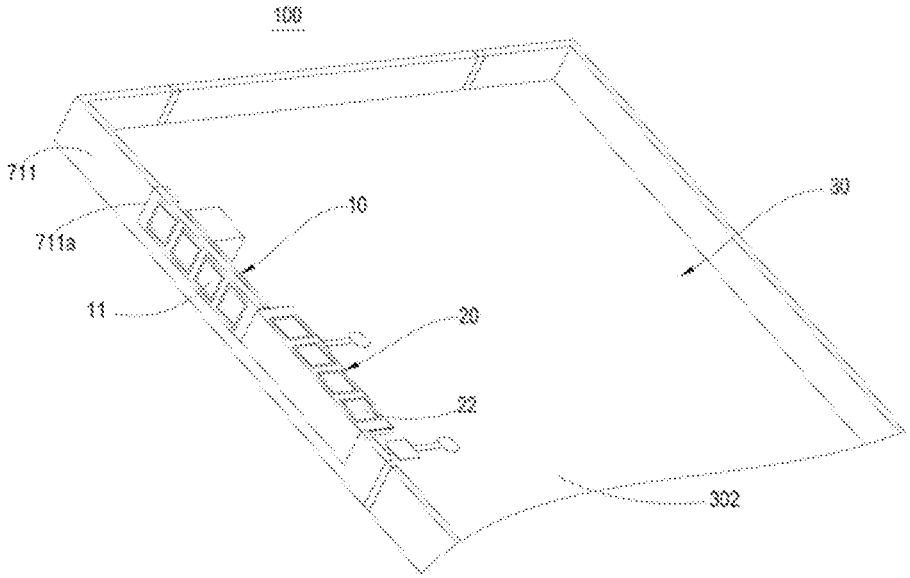
FIG. 47 is a three-dimensional diagram of an antenna device disclosed in Embodiment XV of the present disclosure.
Figure 48:
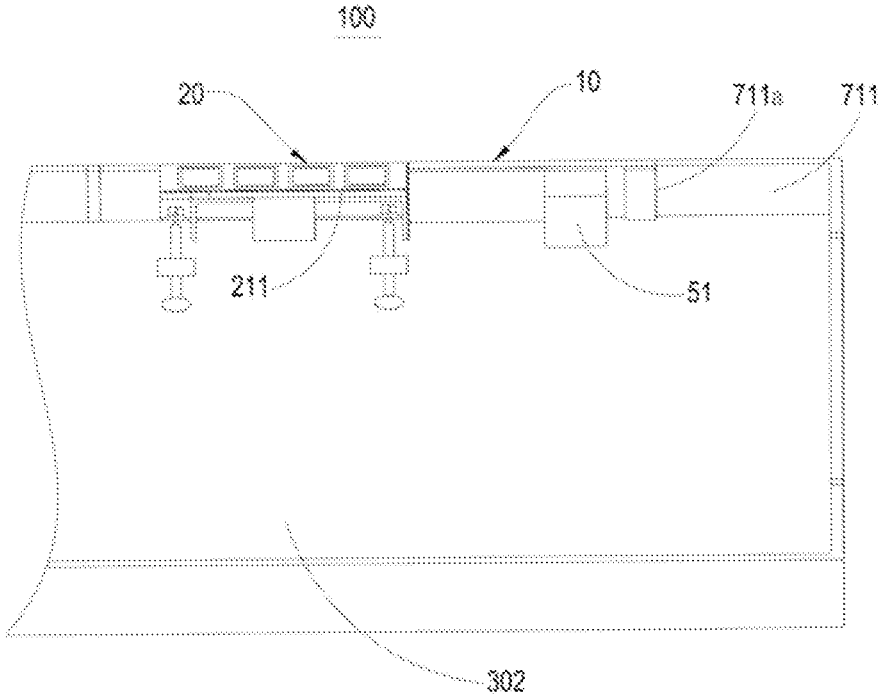
FIG. 48 is a three-dimensional diagram from another view of the antenna device shown in FIG. 47.

Referring to FIG. 47 to FIG. 48, parts, which are the same as those of the antenna device 100 in Embodiment XIV, of the antenna device 100 in this embodiment are not repeatedly described, and descriptions of differences between the antenna device 100 in this embodiment and the antenna device 100 in Embodiment XIV will be emphasized.

In Embodiment XV, the gap 711*a* of the antenna part 711 is relatively long; at least part of the first antenna structure 10 and at least part of the second antenna structure 20 are both arranged in the gap 711*a*; and the second mm-wave antenna 22 is arranged on the first part 211. In addition, the first antenna structure 10 is arranged on the circuit board 30 and is located on the outer side of the first conductive member 51. In addition, the first mm-wave antenna 11 may be located on a first plane, and the second mm-wave antenna 22 may be located on a second plane. The first plane and the second plane may be perpendicular to each other. Specifically, the first plane may be perpendicular to the board surface 302 of the circuit board 30, and the second plane may be parallel to the board surface 302 of the circuit board 30. It can be seen that the position design of the first antenna structure 10 and the second mm-wave antenna 22 on the second antenna structure 20 is beneficial to the flexible structural design of the antenna device 100, such as the flexibility of the routing on the circuit board 30 and the placement of device elements, thus improving the overall competitiveness of the product. In addition, in Embodiment XV, the decorative member in Embodiment XIV may be omitted.

Figure 49:
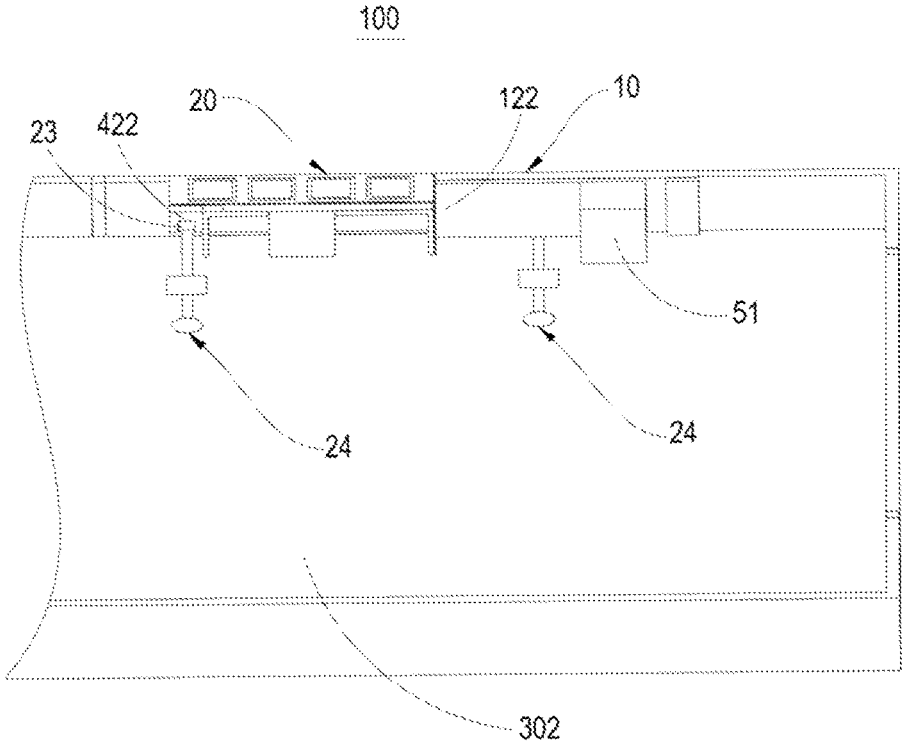
FIG. 49 is a three-dimensional diagram of an antenna device disclosed in a change embodiment of Embodiment XV of the present disclosure.

In addition, as shown in FIG. 49, in one change embodiment of Embodiment XIV, the first shielding case 122 is also used as a non-mm-wave antenna since it is electrically connected to the first non-mm-wave antenna 13 and the second non-mm-wave antenna 23. Therefore, one non-mm-wave antenna feed source assembly 24 may be electrically connected through the first shielding case 122. In addition, the second non-mm-wave antenna 23 is electrically connected to the other non-mm-wave antenna feed source assembly 24 via the second opening part 422. It can be understood that in the above change embodiment, the position design of the non-mm-wave antenna feed source assembly 24 is beneficial to the flexible structural design of the antenna device 100, such as the flexibility of the routing on the circuit board 30 and the placement of device elements, thus improving the overall competitiveness of the product.

Figure 50:
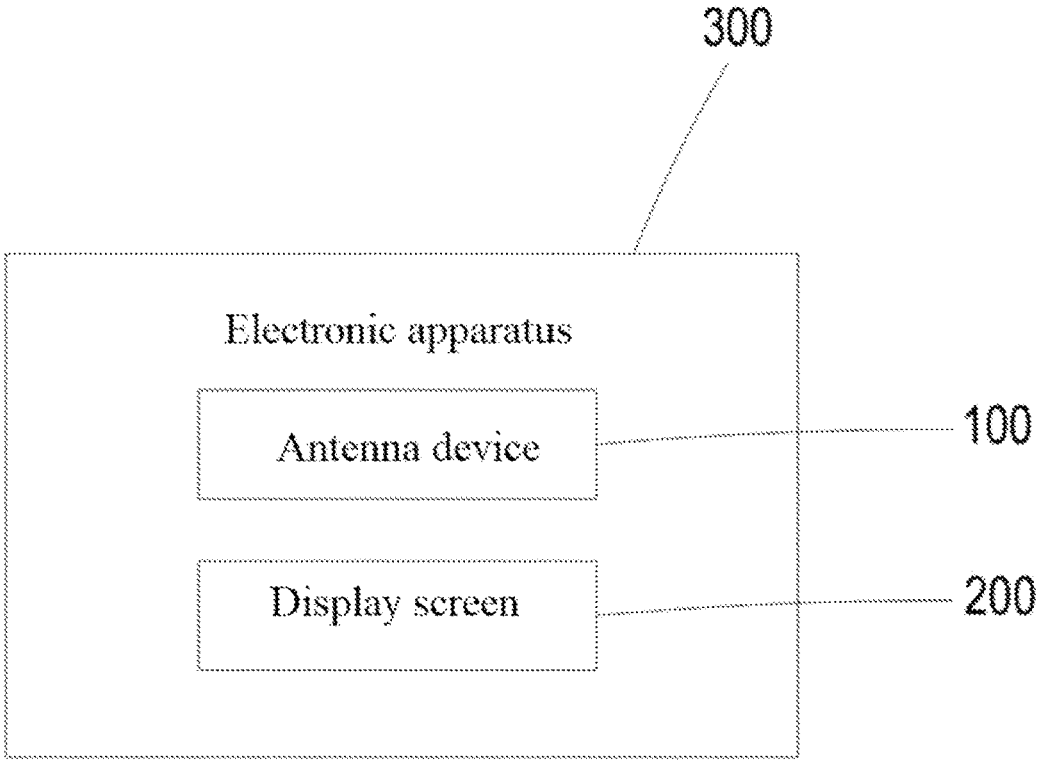
FIG. 50 is a circuit block diagram of an electronic apparatus disclosed in an embodiment of the present disclosure.

As shown in FIG. 50, the present disclosure further discloses an electronic apparatus 300. The electronic apparatus 300 includes the antenna device 100 of any one of the above embodiments, and a display screen 200. The electronic apparatus 300 includes, but is not limited to, a mobile phone, a flat computer, a notebook computer, a desk computer, a camera, and other intelligent terminals. The electronic apparatus 300 uses the antenna device 100 in the foregoing embodiments, so it also has other further features and advantages of the antenna device 100, and descriptions thereof are omitted here.

The electronic apparatuses disclosed in the embodiments of the present disclosure are described in detail above. Specific examples are used here to illustrate the principle and implementation mode of the present disclosure. The descriptions of the above embodiments are only used to help understand the electronic apparatus and its key thoughts of the present disclosure. Moreover, for those of ordinary skill in the art, according to the ideas of the present disclosure, there will be changes in the specific implementation modes and the scope of application. In summary, the content of the present specification should not be construed as limiting the present disclosure.

What is claimed is:

1. An antenna device, the antenna device comprising:

a first antenna structure comprising a first millimeter wave (mm-wave) antenna and a first mm-wave radio-frequency integrated circuit (RFIC) electrically connected to the first mm-wave antenna;

a second antenna structure comprising a flexible printed circuit board and a second mm-wave antenna arranged on the flexible printed circuit board;

wherein the first antenna structure comprises a first non-mm-wave antenna and/or the second antenna structure includes a second non-mm-wave antenna arranged on the flexible printed circuit board, wherein the second antenna structure comprises a second non-mm-wave antenna; the first mm-wave RFIC comprises a first mm-wave RFIC main body and a first shielding case arranged at a periphery of the first mm-wave RFIC main body; the first shielding case is electrically connected to the second non-mm-wave antenna; and at least one of the first shielding case and the second non-mm-wave antenna is connected to a non-mm-wave antenna feed source assembly.

2. The antenna device according to claim 1, wherein the antenna device comprises a circuit board and an antenna stand; the antenna stand is arranged on the circuit board; and the second antenna structure is arranged on the antenna stand.

3. The antenna device according to claim 2, wherein the first antenna structure is arranged on the circuit board; the first shielding case is located between the first mm-wave antenna and the circuit board; the first shielding case is further electrically connected to the circuit board; or, the antenna device further comprises a first conductive member; the first conductive member is electrically connected between the first shielding case and the circuit board and comprises a first metal block; and the first metal block is arranged on the circuit board and is electrically connected to a ground line of the circuit board.

4. The antenna device according to claim 2, wherein the first antenna structure further comprises a base material and a first connector; the first mm-wave antenna, the first mm-wave RFIC, and the first connector are all arranged on the base material; the first connector is electrically connected to the first mm-wave RFIC main body; the first connector is further used to be electrically connected with an external device; the base material comprises a first surface away from one side of the circuit board and a second surface close to one side of the circuit board; the first mm-wave antenna is arranged on the first surface; the first mm-wave RFIC and the first connector are arranged on the second surface in a manner of being spaced apart from each other; the first shielding case is arranged at a periphery of the first mm-wave RFIC main body; a pin of the first mm-wave RFIC main body penetrates through the first shielding case and is electrically connected to the first mm-wave antenna via an electrical connection member penetrating through the base material.

5. The antenna device according to claim 4, wherein the first antenna structure comprises the first non-mm-wave antenna; the first non-mm-wave antenna is electrically connected to the first shielding case; the first non-mm-wave antenna is arranged on the first surface and the second surface; a part of the first non-mm-wave antenna located on the first surface comprises a plurality of first opening regions; the first mm-wave antenna comprises a plurality of first mm-wave antenna units; and the plurality of first mm-wave antenna units are respectively arranged in the plurality of first opening regions and are spaced apart from the first non-mm-wave antenna.

6. The antenna device according to claim 2, wherein the first mm-wave antenna is located on a first plane; the second mm-wave antenna is located on a second plane that is different from the first plane; the first plane is perpendicular to the second plane; and the first plane is perpendicular or parallel to a board surface of the circuit board.

7. The antenna device according to claim 2, wherein the antenna device further comprises a second mm-wave RFIC; the second mm-wave RFIC is arranged on the second antenna structure and is located between the second antenna structure and the antenna stand; the second mm-wave RFIC is electrically connected to the second mm-wave antenna; the antenna device further comprises a second connector; the second connector is arranged on the second antenna structure and is electrically connected to the second mm-wave RFIC and/or the second mm-wave antenna; the second connector and the second mm-wave RFIC are spaced apart from each other; the antenna stand has a first gap part; and at least part of the second connector is located in the first gap part and is used to be connected to another connector.

8. The antenna device according to claim 7, wherein the antenna device further comprises a second conductive member; the antenna stand has an opening;

the antenna structure covers the opening; one end of the second conductive member is arranged on the circuit board, and the other end of the second conductive member passes through the opening and is connected to the second mm-wave RFIC; the mm-wave RFIC comprises a second mm-wave RFIC main body electrically connected to the second mm-wave antenna and a second shielding case arranged outside the second mm-wave RFIC main body; the second conductive member comprises a second metal block; the second metal block is electrically connected between the second shielding case and the ground line on the circuit board; and the second shielding case is further electrically connected to the second non-mm-wave antenna.

9. The antenna device according to claim 2, wherein the antenna stand comprises an inner surface and an outer surface, and the second antenna structure is arranged on the outer surface; the flexible printed circuit board comprises a third surface and a fourth surface located on a side opposite to the third surface; at least part of the second mm-wave antenna is arranged on the third surface; at least part of the second non-mm-wave antenna is arranged on the third surface; the second non-mm-wave antenna is arranged on the third surface; the second non-mm-wave antenna is further electrically connected to the non-mm-wave antenna feed source assembly; the non-mm-wave antenna feed source assembly is arranged on the circuit board; the third surface is a surface away from one side of the outer surface, and the fourth surface is a surface close to one side of the outer surface.

10. The antenna device according to claim 9, wherein the second non-mm-wave antenna comprises a plurality of second opening regions, and the second mm-wave antenna comprises a plurality of second mm-wave antenna units; and the plurality of second mm-wave antenna units are respectively arranged in the plurality of second opening regions.

11. The antenna device according to claim 9, wherein one part of the second non-mm-wave antenna is arranged on the third surface, and the other part of the second non-mm-wave antenna is arranged on the fourth surface; the antenna stand comprises an opening corresponding to the other part of the second non-mm-wave antenna; the antenna device comprises a third conductive member; the third conductive member is arranged on the circuit board and contacts the other part of the second non-mm-wave antenna through the opening, so as to ground the other part of the second non-mm-wave antenna; the third conductive member comprises a third metal block; the other part of the second non-mm-wave antenna comprises a second intermediate part, a third antenna part, and a fourth antenna part; the third antenna part and the fourth antenna part are respectively connected to two ends of the second intermediate part; the second intermediate part is electrically connected to the third conductive member; each of the third antenna part and the fourth antenna part is electrically connected to one non-mm-wave antenna feed source assembly; the third metal block has a through hole; and at least part of the flexible printed circuit board passes through the through hole and is superposed with and electrically connected to the circuit board.

12. The antenna device according to claim 2, wherein the antenna stand comprises a first supporting part and a second supporting part; the second supporting part is connected with the circuit board; the first supporting part is connected to a side of the second supporting part away from the circuit board and is opposite to the circuit board; the flexible printed circuit board comprises a first part and a second part connected to the first part; the first part is arranged on the first supporting part; at least part of the second part is arranged on the second supporting part and is connected to the circuit board; the second mm-wave antenna is arranged on the first part or the second part; and at least part of the second non-mm-wave antenna is arranged on the first part and the second part.

13. The antenna device according to claim 12, wherein the first supporting part, the second supporting part, and the circuit board are further encircled to form an accommodating space.

14. The antenna device according to claim 12, wherein the antenna stand further comprises a third supporting part; the third supporting part is connected to the first supporting part, the second supporting part, and the circuit board; the flexible printed circuit board comprises a third part; the third part is connected to the first part or the second part and is arranged on the third supporting part; and at least part of the second non-mm-wave antenna is arranged on the third part and is electrically connected to the first shielding case.

15. The antenna device according to claim 12, wherein the second part comprises a first sub-part arranged on the second supporting part and a second sub-part connected to the first sub-part; the second sub-part is in bending connection with the first sub-part; the second sub-part is superposed with the circuit board and is connected with the circuit board; the antenna stand comprises an opening part; the second sub-part passes through the opening part; and the second sub-part is electrically connected with the non-mm-wave antenna feed source assembly, the second mm-wave RFIC, and/or the ground line on the circuit board.

16. The antenna device according to claim 12, wherein the antenna stand comprises an opening part; and the second part is electrically connected to the non-mm-wave antenna feed source assembly via an electrical connection member passing through the opening part.

17. The antenna device according to claim 2, wherein the antenna device further comprises a housing; and at least part of the housing is electrically connected to the first non-mm-wave antenna and/or the second non-mm-wave antenna.

18. The antenna device according to claim 17, wherein the housing comprises a side wall structure annularly arranged at a periphery of the circuit board; the side wall structure comprises a gap; at least part of the first antenna structure and/or at least part of the second antenna structure is located in the gap; the antenna device further comprises a decorative member; at least part of the second mm-wave antenna and/or the second non-mm-wave antenna corresponds to the gap; and the decorative member is located in the gap and covers at least part of the second mm-wave antenna and/or the second non-mm-wave antenna.

19. An electronic apparatus, the electronic apparatus comprising the antenna device according to claim 1.

20. The antenna device according to claim 1, wherein the first shielding case directly contacts with the second non-mm-wave antenna so as to electrically connected to the second non-mm-wave antenna.

* * * * *